US012011648B2

(12) United States Patent
Abdelmoneum et al.

(10) Patent No.: US 12,011,648 B2
(45) Date of Patent: Jun. 18, 2024

(54) ADAPTIVE TENNIS BALL MACHINE

(71) Applicants: Farida Abdelmoneum, Portland, OR (US); Aleena Mughal, Portland, OR (US)

(72) Inventors: Farida Abdelmoneum, Portland, OR (US); Aleena Mughal, Portland, OR (US)

(73) Assignee: SurfaSense LLC, Portland, OR (US)

( * ) Notice: Subject to any disclaimer, the term of this patent is extended or adjusted under 35 U.S.C. 154(b) by 0 days.

(21) Appl. No.: 18/047,252

(22) Filed: Oct. 17, 2022

(65) Prior Publication Data

US 2023/0123704 A1 Apr. 20, 2023

Related U.S. Application Data

(63) Continuation of application No. 16/721,821, filed on Dec. 19, 2019, now Pat. No. 11,471,741.
(Continued)

(51) Int. Cl.
*A63B 69/40* (2006.01)
*A63B 24/00* (2006.01)
(Continued)

(52) U.S. Cl.
CPC ..... *A63B 69/406* (2013.01); *A63B 24/0062* (2013.01); *A63B 71/0622* (2013.01);
(Continued)

(58) Field of Classification Search
CPC ..... A63B 69/406; A63B 24/0062; A63B 71/0622; A63B 69/38; A63B 2024/0028;
(Continued)

(56) References Cited

U.S. PATENT DOCUMENTS 5,464,208 A 11/1995 Pierce
10,722,775 B2 * 7/2020 Black ..... A63B 71/0686
(Continued)

FOREIGN PATENT DOCUMENTS

EP 3557559 A1 10/2019

OTHER PUBLICATIONS

Wojcicki, Krysztof et al., "Mathematical Analysis for a New Tennis Ball Launcher", Acta Mechanica et Automatica, vol. 5, No. 4, 2011, 9 pgs.

(Continued)

*Primary Examiner* — Jeffrey S Vanderveen
(74) *Attorney, Agent, or Firm* — MUGHAL GAUDRY & FRANKLIN PC

(57) ABSTRACT

A smart ball-machine uses artificial intelligence to train a player or to play with a player. For example, the ball-machine can adjust the tennis ball speed, topspin, bounce according to the player's successful ball return rate. The ball-machine can be preconfigured with a profile of a player. For example, the ball-machine may download a complete profile of a tennis player from a game recording, or may download a file with a customized profile of a player to train a player using the ball-machine. The ball-machine is equipped with a plurality of wheels, motors, and shafts to provide a fully customizable launch of one or more balls. For example, the ball can be launched from the machine from one side of a tennis court to another side of a tennis court with a variety of speeds, trajectories, topspin, bounce etc.

20 Claims, 13 Drawing Sheets

Related U.S. Application Data

(60) Provisional application No. 62/783,507, filed on Dec. 21, 2018.

(51) Int. Cl.
*A63B 69/38* (2006.01)
*A63B 71/06* (2006.01)

(52) U.S. Cl.
CPC ..... *A63B 2024/0028* (2013.01); *A63B 2024/0037* (2013.01); *A63B 2024/0093* (2013.01); *A63B 69/38* (2013.01); *A63B 2069/402* (2013.01); *A63B 2071/063* (2013.01); *A63B 2071/0694* (2013.01); *A63B 2220/05* (2013.01); *A63B 2220/70* (2013.01); *A63B 2220/806* (2013.01); *A63B 2220/833* (2013.01); *A63B 2225/093* (2013.01); *A63B 2225/20* (2013.01); *A63B 2225/52* (2013.01)

(58) Field of Classification Search
CPC .... A63B 2024/0037; A63B 2024/0093; A63B 2069/402; A63B 2071/063; A63B 2071/0694; A63B 2220/05; A63B 2220/70; A63B 2220/806; A63B 2220/833; A63B 2225/093; A63B 2225/20; A63B 2225/52; A63B 24/0075; A63B 24/0084; A63B 2024/0025; A63B 2024/0034; A63B 2071/0666; A63B 2071/0675; A63B 2220/89; A63B 71/0669; A63B 2024/0031; A63B 2024/0043; A63B 2024/0056; A63B 2024/0081; A63B 2071/025; A63B 2071/0625; A63B 2210/50; A63B 2220/20; A63B 2220/30; A63B 2220/35; A63B 2220/56; A63B 2220/72; A63B 2220/74; A63B 2220/76; A63B 2225/15; A63B 2225/50
See application file for complete search history.

(56) References Cited

U.S. PATENT DOCUMENTS

| | | | | |
|---|---|---|---|---|
| 10,912,981 | B1 | 2/2021 | Afrouzi | |
| 2014/0277635 | A1 | 9/2014 | Thurman | |
| 2016/0310817 | A1 | 10/2016 | Yeager | |
| 2017/0095716 | A1 | 4/2017 | Lewis et al. | |
| 2018/0292817 | A1* | 10/2018 | Yang | G01P 13/045 |
| 2019/0077007 | A1* | 3/2019 | Mallinson | A61B 5/1118 |
| 2019/0369641 | A1* | 12/2019 | Gillett | B62D 57/028 |
| 2020/0057133 | A1* | 2/2020 | Arteaga | B64C 39/024 |
| 2020/0130829 | A1* | 4/2020 | Gandiga | G05D 1/0061 |
| 2021/0008416 | A1 | 1/2021 | DeCarlo | |
| 2021/0060391 | A1* | 3/2021 | Legg | A63B 24/0003 |
| 2022/0029438 | A1* | 1/2022 | Maurer | B60L 53/16 |
| 2022/0106036 | A1* | 4/2022 | Kuehn | G05D 1/0684 |
| 2023/0302329 | A9* | 9/2023 | Legg | A63B 69/40 |

OTHER PUBLICATIONS

Xiong, Rong et al., "Impedance Control and its Effects on a Humanoid Robot Playing Table Tennis", International Journal of Advanced Robotics Systems, vol. 9, 2010, 11 pgs.
Yan, Fei et al., "Ball Tracking for Tennis Video Annotation", Advances in Computer Vision and Pattern Recognition, 2014, 22 pgs.
Zagoria, Adam, "Where Have all the American Tennis Tournaments Gone?", Apr. 15, 2019.
Zhang, Cheng et al., "MV-Sports: A Motion and Vision Sensor Integration-Based Sports Analysis System", IEEE Conference on Computer Communications, 2018, 10 pgs.
Retrieved online Jan. 10, 2020.
Retrieved online Jan. 13, 2020.
Retrieved online Jan. 14, 2020.
"10 Reasons Why High School Sports Benefit Students", retrieved online Jan. 10, 2020.
"Generating Panoramic Views by Stitching Multiple Fisheye Images", May 2009, Version 1.0, 9 pgs.
"Global Tennis Equipment Market Analysis, Opportunities & Forecasts 2011-2022", Aug. 15, 2017.
"How a Tennis Ball Machine Could Take Your Game to the Next Level", retrieved online Jan. 14, 2020.
"Man vs. machine: ping pong robot shown in Hangzhou, China", euronews, Mar. 12, 2014.
"Tennis, Anywhere?", retrieved online Jan. 14, 2020.
"The Benefits of High School and Youth Sports", retrieved online Jan. 10, 2020.
"What are the Mental and Physical Health Benefits of Tennis?", Dec. 11, 2016.
Alyamkin, Sergei et al., "Low-Power Computer Vision: Status, Challenges, Opportunities", Journal on Emerging and Selected Topics in Circuits and Systems, retrieved online Jan. 14, 2020.
Bacic, Boris, "Towards the next generation of exergames: Flexible and personalised assessment-based identification of tennis swings", retrieved online Jan. 14, 2020.
Brechbuhl, Cyril et al., "Accuracy and Reliability of a New Tennis Ball Machine", Journal of Sports Science and Medicine 15, 2016, 6 pgs.
Brown, Kelly A. et al., "Participation in sports relation to adolescent growth and development", 2017.
Campa, Giampiero, "Tennis", retrieved online Jan. 14, 2020.
Chao, Hsiao-Wen et al., "Kinematic Analysis of Tennis Volley", Journal of Coaching and Sports Performance, Jul. 2008, 5 pgs.
Choubassi, Maha E. et al., "Stabilized High-Speed Video from Camera Arrays", International Symposium on Electronic Imaging, 2017, 7 pgs.
Collins, Nandini M. et al., "Effects of Early Sport Participation on Self-esteem and Happiness", retrieved online Jan. 10, 2020.
Cox, David, "Young at heart: why children who exercise become healthier adults", Aug. 28, 2017.
Cross, Rod et al., "Tennis Ball Trajectories: Aerodynamic Drag and Lift in Tennis Shots", retrieved online Jan. 14, 2020.
Cross, Rod, "Physics of the Tennis Kick Serve", retrieved online Jan. 14, 2020.
Fazio, Megan, "Tennis Ball Tracking: 3D Trajectory Estimation using Smartphone Videos", retrieved online Jan. 14, 2020.
Felfe, Christina et al., "Sports and Child Development", May 4, 2016.
Final Office Action dated May 13, 2022 for U.S. Appl. No. 16/721,821.
Gloster, Rob, "The Brutal Costs of Raising the World's 631st-Best Tennis Player", Bloomberg, Aug. 28, 2015.
https ://cleanhomeworld .com/roomba-dies-before-docking/ (Year: 2020).
Kovacs, Ferenc et al., "Highly Accurate Tennis Ball Throwing Machine with Intelligent Control", International Journal of Mechanical and Mechatronics Engineering, vol. 9, No. 9, 2015, 5 pgs.
Kovacs, Mark et al., "An 8-Stage Model for Evaluating the Tennis Serve: Implications for Performance Enhancement and Injury Prevention", Journal of Sports Health, vol. 3, No. 6, Nov.-Dec. 2011, 10 pgs.
Landlinger, Johannes et al., "Key factors and timing patterns in the tennis forehand of different skill levels", Journal of Sports Science and Medicine, 2010, 9 pgs.
Negron, Izak et al., "SkillCourt Autonomous Ball Launcher", 30th Florida Conference on Recent Advances in Robotics, May 11-12, 2017, 9 pgs.
Noah, Meg, "Model a Tennis Serve Ball Flight", retrieved online Jan. 14, 2020.
Non-Final Office Action dated Jan. 20, 2022 for U.S. Appl. No. 16/721,821.
Notice of Allowance dated Jun. 9, 2022 for U.S. Appl. No. 16/721,821.
Oley, Stan, "How to properly market your ball machine", Jan. 2009.
Paljug, Katharine, "Benefits of Tennis for Seniors", Feb. 6, 2017.

(56) References Cited

OTHER PUBLICATIONS

Pannekeet, Jurre, "Newzoo: Global Esports Economy Will Top $1 Billion for the First Time in 2019", Feb. 12, 2019.
Pingali, Gopal et al., "Ball Tracking and Virtual Replays for Innovative Tennis Broadcasts", retrieved online Jan. 14, 2020.
Pluim, Babette M. et al., "Health benefits of tennis", May 15, 2007.
Polceanu, Mihai et al., "Real Time Tennis Match Tracking with Low Cost Equipment", The Thirty-First International Florida Artificial Intelligence Research Society Conference (FLAIRS-31), Florida, 2018, 4 pgs.
Reno, Vito et al., "Convolutional Neural Networks based ball detection in tennis games", National Research Council of Italy—Institute of Intelligent Systems for Automation, Jun. 2018, 8 pgs.
Sakurai, Shinji et al., "Ball spin in the tennis serve: spin rate and axis of rotation", Sports Biomechanics, iFirst article, 1-7, 2012, 9 pgs.
Sawe, Benjamin E., "The Most Popular Sports in the World", retrieved online Jan. 10, 2020.
Shackelford, Avery, "The 10 Best Cities for Tennis Players", Feb. 6, 2015.
Sheets, Alison L. et al., "Kinematics Differences Between the Flat, Kick, and Slice Serves Measured Using a Markerless Motion Capture Method", Annals of Biomedical Engineering, vol. 39, No. 12, Dec. 2011, 11 pgs.
Sikka, Aman et al., "CS229: Action Recognition in Tennis", retrieved online Jan. 14, 2020.
Simmons, Lewis, "New Techniques for Tennis Ball Motion Tracking", The University of Queensland, Bachelor of Engineering Thesis, Oct. 2016, 100 pgs.
Sullivan, Elizabeth, "The Impact of Sports on Middle School Students", Nov. 28, 2018.
Vollmer, M. et al., "Infrared Thermal Imaging: Fundamentals, Research and Applications", Wiley-VCH, 2010, p. 157-234.
Wilburn, Bennett et al., "High-Speed Videography Using a Dense Camera Array", Department of Electrical Engineering, Department of Computer Science, Stanford University, retrieved online Jan. 14, 2020, 8 pgs.

* cited by examiner

ADAPTIVE TENNIS BALL MACHINE

CLAIM OF PRIORITY

This application is a continuation of, and claims the benefit of priority to U.S. patent application Ser. No. 16/721,821, filed Dec. 19, 2019, and now issued as U.S. Pat. No. 11,471,741 on Oct. 18, 2022, and which claims priority to U.S. Provisional Application No. 62/783,507 filed Dec. 21, 2018, titled "Adaptive Tennis Ball Machine," which are incorporated by reference in its entirety.

BRIEF BACKGROUND

Existing ball-machines for tennis are bulky and non-versatile. These machines are set to throw balls from one location set by a user. To change the setting, the ball-machine is manually reconfigured to throw a ball to another location. Existing ball-machines are not suites for adaptive and dynamic training of a player.

BRIEF DESCRIPTION OF THE DRAWINGS

The embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1:
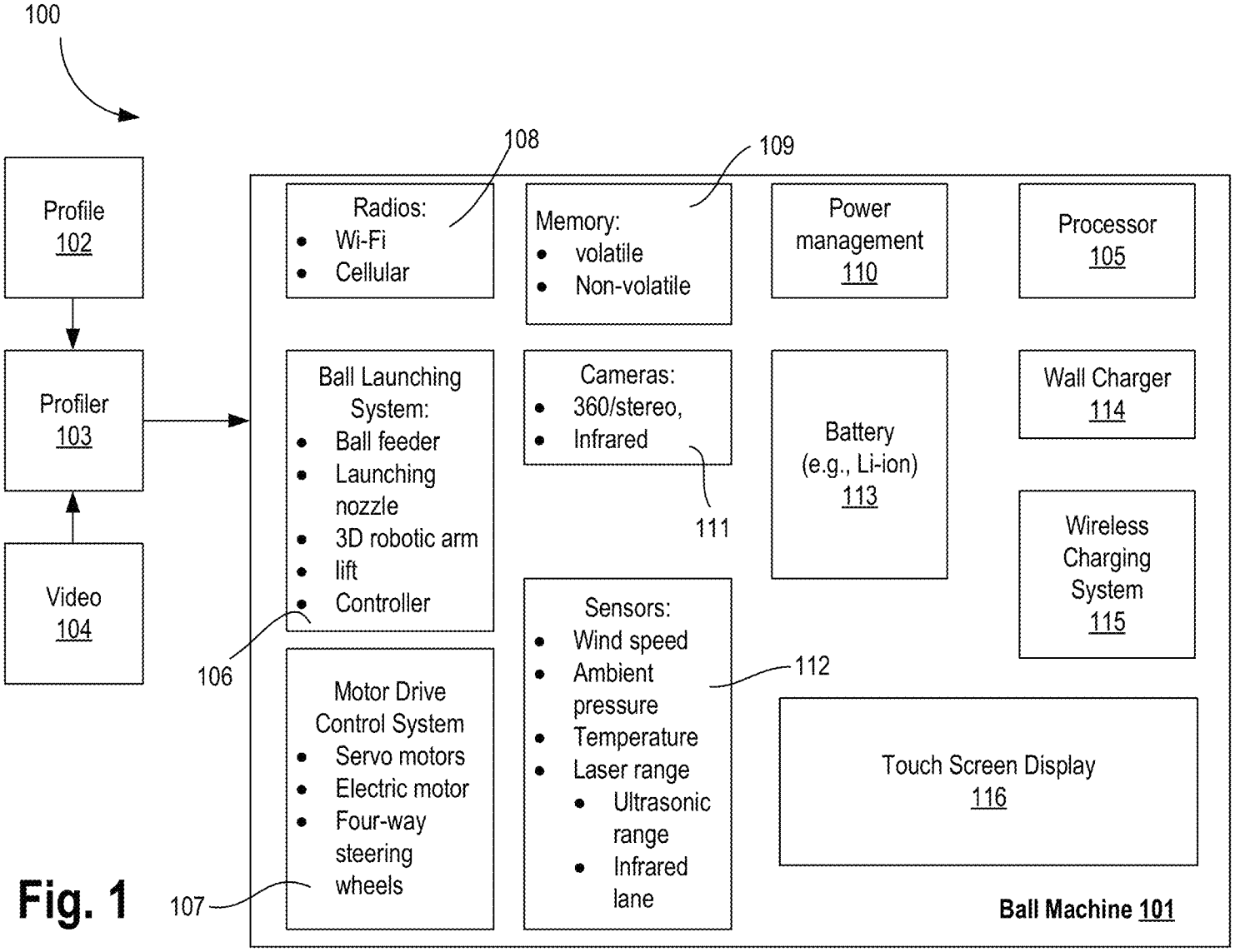
FIG. 1 illustrates a system with various components of a ball-machine, in accordance with some embodiments.

The embodiments of the disclosure describe a smart ball-machine, which uses artificial intelligence (AI) to train a player. For example, the ball-machine can adjust the tennis ball speed, topspin, bounce, and other parameters according to the player's successful ball return rate. In some embodiments, a profile of a player is input to the ball-machine to pre-configure the ball-machine. For example, the ball-machine may download a complete profile of a tennis player from a game recording, or may download a file with a customized profile of a player to train a player using the ball-machine. In some embodiments, the ball-machine is equipped with a plurality of wheels, motors, and shafts to provide a fully customizable launch of one or more balls towards one or more players. For example, the ball-machine can launch a ball from one side of a tennis court to another side of a tennis court with a variety of locations, speeds, trajectories, topspin, bounce, etc.

In some embodiments, the ball-machine includes a robotic arm to simulate a tennis serve. In some embodiments, the ball-machine includes a lift to raise its platform to mimic a serve or throw of a ball from a players' height and arm length. In some embodiments, the ball-machine includes a variety of sensors to control the characteristics of the ball, which is being thrown. For example, the ball-machine has environmental sensors to sense temperature of the playing area (e.g., court, stadium), air pressure, wind speed and direction, to compensate for them when launching the ball to deliver the targeted anticipated trajectory. In some embodiments, the ball-machine includes a variety of lasers to monitor the position of the ball after release from the machine and after being returned by a player. For example, the ball-machine includes an array of visible light cameras and infrared cameras to capture the motion of the player and the ball. The array of visible light cameras and infrared cameras can be 2D (two-dimensional) array or a 3D (three-dimensional array) like on spherical configuration. In some embodiments, the ball-machine includes a battery, which is rechargeable via a cable or wireless means. In some embodiments, the ball-machine includes communication equipment (e.g., Wi-Fi, radios) to send and receive data to and from one or more devices (e.g., smart phone, tablet, cloud, etc.). In some embodiments, the ball-machine has 4-way steering wheels that allows it to move in any direction on the court. In some embodiments, the ball-machine, upon low battery, can park itself to a charging station to charge.

In some embodiments, the ball-machine can be packed or folded into a small rectangular box of a size comparable to a suite case that can easily fit into a trunk of a car or loaded onto an airplane as a regular bag or a canyon bag. The ball-machine of various embodiments has upgradable software that allows the ball-machine to throw a ball at the same rate and speed as a professional tennis player or players. The ball-machine can track a player's progress and post that progress to an account of the player. A downloadable application of the ball-machine can access the player's account. The ball-machine allows the player to train so that the player stays consistent with his/her shots. A wireless remote can control the ball-machine. For example, a smart device or a dedicated wireless remote for the ball-machine can instruct the machine to change its location and other parameters. The remote functions can also be part of an application downloaded on a smart device. The ball-machine has a touch screen to control or configure the ball-machine parameters (e.g., speed, spin, slice of the ball).

There are many technical effects of the various embodiments. For example, the ball-machine coaches a player at any playing level (e.g., beginners to professional), without the need for a physical human coach. As such, the ball-machine democratizes the sport of tennis to masses by making it affordable to learn the sport. The AI aspect of the ball-machine causes the machine to learn and adapt according to a player's progress. The ball-machine also tracks the players' progress in terms of various parameters (e.g., shot return rate, misses, speed of return, etc.). The ball-machine is programmable to adapt according to any user profile (real or arbitrary), or a gaming profile (real or arbitrary). This allows a user to practice his or her game according to any desired difficulty level with a professional-like opposing player in the form of an intelligent ball-machine. Other technical effects will be evident according to the figures and various embodiments.

Note that in the corresponding drawings of the embodiments, signals are represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

The term "device" may generally refer to an apparatus according to the context of the usage of that term. For example, a device may refer to a stack of layers or structures, a single structure or layer, a connection of various structures having active and/or passive elements, etc. Generally, a device is a three-dimensional structure with a plane along the x-y direction and a height along the z direction of an x-y-z Cartesian coordinate system. The plane of the device may also be the plane of an apparatus, which comprises the device.

Throughout the specification, and in the claims, the term "connected" means a direct connection, such as electrical, mechanical, or magnetic connection between the things that are connected, without any intermediary devices.

The term "coupled" means a direct or indirect connection, such as a direct electrical, mechanical, or magnetic connection between the things that are connected or an indirect connection, through one or more passive or active intermediary devices.

The term "adjacent" here generally refers to a position of a thing being next to (e.g., immediately next to or close to with one or more things between them) or adjoining another thing (e.g., abutting it).

The term "circuit" or "module" may refer to one or more passive and/or active components that are arranged to cooperate with one another to provide a desired function.

The term "signal" may refer to at least one current signal, voltage signal, magnetic signal, or data/clock signal. The meaning of "a," "an," and "the" include plural references. The meaning of "in" includes "in" and "on."

The terms "substantially," "close," "approximately," "near," and "about," generally refer to being within +/−10% of a target value.

Unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner.

For the purposes of the present disclosure, phrases "A and/or B" and "A or B" mean (A), (B), or (A and B). For the purposes of the present disclosure, the phrase "A, B, and/or C" means (A), (B), (C), (A and B), (A and C), (B and C), or (A, B and C).

The terms "left," "right," "front," "back," "top," "bottom," "over," "under," and the like in the description and the claims, if any, are used for descriptive purposes and not necessarily for describing permanent relative positions.

It is pointed out that those elements of the figures having the same reference numbers (or names) as the elements of any other figure can operate or function in any manner similar to that described, but are not limited to such.

FIG. 1 illustrates system 100 with various components of a ball-machine, in accordance with some embodiments. The system includes a ball-machine 101, profile 102, profiler 103, and video 104. Profiler 103 receives profile 102. Profile 102 can be a player profile from a text file or from a video recording 104 of a player playing tennis. In some embodiments, ball-machine 101 includes a processor 105 (e.g., an artificial intelligence processor), ball launching mechanism 106, motor drive control system 107, radios 108, memory 109, power manager 110, cameras 111, sensors 112, battery 113, wall charger 114, wireless charging system 115, and touch screen display 116.

Ball-machine 101 is a smart ball-machine, which receives instructions from profiler 103 and controls how and when to launch one or more balls from machine 101 to a player. For example, ball-machine 101 launches one or more balls so they land in a defined target location with a specific spin and stroke. While various embodiments are described with reference to autonomous mode operation of ball-machine 101, the embodiments are also applicable to semi-autonomous version of ball-machine 101. In a semi-autonomous version of ball-machine 101, a remote coach (e.g., human coach) can control ball-machine 101 to train the player and ball-machine 101 analyzes the ball returns by the player and provides feedback to the remote coach and to the player. The remote coach can be on the same court as the player, or a different location (e.g., different country). In some embodiments, ball-machine 101 is pre-programmed with a set of instructions to simulate player strokes. In some embodiments, a user can use a smart phone or any computing device communicatively coupled to ball-machine 101 to change the player strokes.

In some embodiments, profiler 103 comprises a software that analyzes a user identified tennis video and translates it to patterns, sequences and instructions for a processor to launch a ball (e.g., tennis ball) mimicking the strokes of selected opponent player in the specified video. In some embodiments, profiler 103 generates the instructions to be displayed and/or audio broadcasted to the user (or player) to enable the user/player to counter the ball shot at the user/player by the machine. In some embodiments, profiler 103 displays step-by-step instructions for the user to counter the shots in a play. In some embodiments, profiler 103 uses a machine learning video analytics algorithms like multi-stage convolution networks that maps the position of the players, type of stroke, ball speed, ball landing position, ball angle, and type of spin and general pattern of the players.

In some embodiments, profiler 103 or any other aspect of the ball (or any sports object) control and ejecting machine can download a game plan and other game parameters. Examples of game parameters include ball/sports object trajectories, speed, type of swing for the hit, number of strokes, and all the analytics and statistics needed (or translated information statistics/control instructions) for processor 105 of ball-machine 101 to control different aspects of ball-machine 101. For example, processor 105 can control the rotors and arms of machine 101 to adjust the ball eject-launcher to mimic a player hitting or pitching the ball.

The download of the game plan or profile 102 can be from the cloud or from a handheld device that is wired to machine 101 or wirelessly connected to ball-machine 101. For example, the machine has a plurality of radios 108 to communicate wirelessly (e.g., using Bluetooth, WiFi or cellular standards as well as using wired communications like Ethernet). The downloaded game plan 102 can be an output of a computer vision machine learning algorithm(s) that performs video analytics for a video of a game (e.g., tennis game) that can be captured in real-time or recorded and uploaded by a user through a web interface. An analytics algorithm(s) can be applied to game plan 102. The analytics algorithms can also be running on ball-machine 101 itself or on another device that can be wired or wirelessly connected to ball-machine 101. A user can record a game from TV, internet, or a video camera, and then upload it to the cloud through a web interface. After uploading, analytic s algorithms analyze the game and generate the ball/sports object statistics. These statistics are then downloaded to ball-machine 101 and the user selects the pitcher/starter player that he/she wants to practice the game against. Ball-machine 101 will then execute the statistics attributed to that pitcher as indicated by the downloaded statistics. The statistics are defined per ball stroke with reference to ball launching position on court, swing type (forehand, backhand), spin type, ball speed, trajectory angle, and/or ball landing position on the court.

The downloaded game 102 or output of the profiler 103 is stored in memory 109. Memory 109 of the ball-machine can be any suitable volatile (e.g., static random access memory) or non-volatile memory (e.g., NAND, NOR flash memory, magnetic random access memory, ferroelectric memory, resistive random access memory, phase-change memory). In some embodiments, profile 102 is provided to ball-machine 101 using a memory device such as a USB (universal serial bus) based flash drive. In some embodiments, memory 109 is a machine-readable medium for storing computer-executable instructions (e.g., instructions to implement any other processes discussed herein). The machine-readable medium may include, but is not limited to, flash memory, optical disks, CD-ROMs, DVD ROMs, RAMs, EPROMs, EEPROMs, magnetic or optical cards, phase change memory (PCM), or other types of machine-readable media suitable for storing electronic or computer-executable instructions. For example, embodiments of the disclosure may be downloaded as a computer program (e.g., BIOS) which may be transferred from a remote computer (e.g., a server) to a requesting computer (e.g., a client) by way of data signals via a communication link (e.g., a modem or network connection).

In some embodiments, processor 105 is a controller that runs software to translate the steps, generated by the profiler, to instructions for the different actuators in ball-machine 101. For example, processor 105 sends instructions to control the speed of the rotors, nozzle angle, nozzle elevation, nozzle bearing and the position of one or more 3D arms if used in the machine. Processor 105 may be a Digital Signal Processor (DSP), a graphics processor (GPU), an Application Specific Integrated Circuit (ASIC), a general purpose Central Processing Unit (CPU), or a low power logic implementing a simple finite state machine to perform the various operations by the ball-machine.

In some embodiments, ball-machine 101 comprises ball-launching system 106 that includes various mechanisms to feed and throw the ball in a controlled manner. In some embodiments, ball-launching system 106 comprises multiple ball ejectors where the ball ejector is connected to a robotic arm that can move the ball ejector in the X, Y and Z directions to position the ejector to launch the ball to simulate a serve, for example. In another embodiment, ball-machine 101 can have a stage connected to the propulsion and steering system described above comprising electric motors and servo motors. The stage may have a ball ejector system. In some embodiments, the stage can lift the top part of the machine which has a ball ejecting system and rotate it in the X-Y plane while lifting it up to simulate the serve position. In some embodiments, a hydraulic system or an electronic motor can be used to lift the ball ejecting system. An onboard controller can control the various components of ball-launching system 106.

In some embodiments, ball-launching system 106 includes a target-locking system to lock a player on the court so that the balls can be ejected according to the position of the player. For example, in some cases the ball may be thrown to the player and in other cases, the ball may be thrown away from the player to make the player run for the ball. These target-locking devices may also be located on the court, in accordance with some embodiments.

A ball feeder stores a number of balls (e.g., 10-15 balls) in ball-machine 101. In some embodiments, a bag of balls is attachable to the ball feeder of ball launching system 106. The bag can be a refillable bag. In some embodiments, the bag moves with the machine such that it does not hinder in the operations of machine 101.

In various embodiments, ball-machine 101 includes a single or multiple range-measuring device, with a single arm or multiple robotic arms, with an adjustable feeder. The adjustable feeder supports different ball sizes or multiple feeders for each ball size. The adjustable feeder is coupled with multiple motors connecting to a single or plurality of wheels touching the ground to control and move the ball-machine. Ball-machine 101 may also include a microprocessor, storage, graphics device, memory, loud speakers, microphone, single or multiple displays and plurality of input/output devices. The plurality of input/output devices can be used to download software, service any error codes, etc.

In some embodiments, ball-machine 101 comprises motor drive control system 107 that works closely with ball-launching system 106. Motor drive control system 107 includes multiple sets or independent rotors to generate the different complex patterns in an actual tennis game beyond what exists today in the two-rotor system used in the current ball-machines. Motor control driver 107 may be connected to single or multiple motors. Ball-launching system 106 may include single or multiple robotic arms connected to a feeder to generate the serve (which does not exist today) and the return with a backhand or forehand. The feeder provides the source of balls to ball-launching system 106. In some embodiments, instead of the robotic arm, or in addition to it, the launching and feeding systems may be positioned on a 3D robotic stage that can lift the entire ball-machine 101 and orient it to simulate the different shots like the function performed by the robotic arms.

In some embodiments, ball-machine 101 is propelled by motor drive control system 107 using an array of electric motors that is steered using an array of servomotors. The motor drive control unit 107 drives multiple motors, where a motor is connected to a wheel/tire or a motor and a wheel/tire are in/on one assembly. A servomotor rotates each motor and wheel assemblies so that all the wheels are independently rotated in the same direction and the machine is propelled instantaneously in that direction, in accordance with some embodiments. In some embodiments, motor drive control unit 107 includes a propulsion and steering system that enables autonomous motion of ball-machine 101 on the court to enable all kinds of serves and strokes.

In various embodiments, ball-launching system 106 conditions itself according to information gleaned or measured by one or more sensors 112. Sensors 112 include a mini weather station to measure the atmospheric pressure, wind speed and temperature and to provide the ambient measurements for processor 105 to apply correction factors to launching system instructions for the play steps to compensate for the ambient effects on the ball trajectory.

In some embodiments, the one or more sensors 112 of the ball-machine 101 include sensors in a ball feeder to measure the ball diameter and ball elasticity. This measured data is provided to the processor to modify the launching system instructions for the play steps. For example, the launching system can be modified to compensate for variations in the ball mechanical properties that effect ball trajectory.

In some embodiments, ball-machine 101 includes cameras to sense the launched ball as it launches from ball-machine 101. Cameras 111 also monitor the balls returned by a player. In some embodiments, cameras 111 include a single or a plurality of 360° cameras or stereo cameras and/or one or more infrared cameras. In some embodiments, cameras 111 are fitted to ball-machine 101 or on the court or an unmanned vehicle to perform the video capture of the user responding to the different strokes generated by ball-machine 101. The infrared cameras track the ball and/or player using their thermal trail. For example, when the player changes position or the ball touches the court, the memory aspect of the infrared camera can capture the player's position for a couple (or more) frames until the player's thermal footprint reaches equilibrium with the surrounding. The same is applicable to the ball trail. For example, when a ball hits the court, energy is transferred from the ball to the court in the impact area and even through the ball has already moved on; the position of the ball can be captured on the court for couple of frames using the infrared camera. The cameras can be visible light cameras or infrared cameras, or a mix of both types. In some embodiments, ball-machine 101 is equipped with active infrared sensors at the bottom of machine 101 to track the white lines on the court for navigating the court position.

In some embodiments, a ball/sports object control and ejecting machine captures a user's response of an ejected ball through a plurality of cameras 111 and range finders. For example, when ball-machine 101 throws a ball using the downloaded instructions by the profiler or by any other source, cameras 111 and/or range finders are used to track the ball as it leaves the ball-machine. In some embodiments, processor 105 can process the response or the response is uploaded to a wired device/wireless device/cloud through a web interface to profile the response of the user (player) and provide feedback control to the processor to change the speed/pace of the pitched/ejected ball/sports object.

In some embodiments, other tracking devices like inertial sensors (e.g., part of sensors 112) are fitted to the racquet of a player or a user to send data wirelessly to the feedback system (e.g., processor) of ball-machine 101 to generate the force, speed and orientation of the user racquet when hitting the ball. In some embodiments, the feedback system may create a real time profile of the user. The real time profile of the user may include how the user is responding to the virtual player generated by the profiler. The feedback system can then adjust some parameters generated in the profile to enable the user to execute the drills successfully at a slower pace or speed. Once the feedback system identifies to the user passing a threshold or successfully executing the drill/play then ball-machine 101 will gradually increase (by controlling ball-launching system 106) the pace and/or speed step-by-step to match the actual player in the profile.

In some embodiments, ball-machine 101 includes one or more displays 116 (e.g., touch pad or any suitable display). In some embodiments, ball-machine 101 is communicatively coupled to one or more displays in a court. In some embodiments, ball-machine 101 displays instructions on a plurality of displays including head-mounted displays worn by the user or on the display of any other wearable or mobile device accessible by the user (or player) describing a position, move and type of return shot the player should perform to successfully return the ball/sports object ejected/launched.

For example, a player wearing a goggle with a built-in camera receives coaching instructions to return the ball (that was launched by machine 101) to mimic the play of the player the in the profile. This player in the profile can also be the player from the downloaded game. Ball-machine 101 can generate an audio of the instructions for the moves, plays and the type of return the user (or player) needs to follow to be able to return launched/ejected ball/sports object. In some embodiments, ball-machine 101 can send instructions to a plurality of wearable devices that the user wears to generate haptics or audio or video or the three modalities instructing the user with the steps, moves, and/or type of return hit that the user need to perform to be able to return the ball/sports object.

In some embodiments, ball-machine 101 includes a user authentication system like a virtual keypad and a display or a real keypad for entering a user name and a pin or a fingerprint reader or the combination of display, virtual keypad and a fingerprint reader, face identifier. The authentication system allows the user to engage with the ball-machine and to provide security to the data stored on the ball-machine.

In some embodiments, ball-machine 101 includes an online progress monitoring system where user statistics are uploaded after each practice and a trend is generated with highlights of strengths and areas of improvements.

In some embodiments, ball-machine 101 comprises power management unit 110, a battery bank 113 (Li-ion) and a wired charging system 114, a wireless charging system 115. Power management system 110 monitors the battery level or charge level of battery 113 using a fuel gauge of the battery. Depending on the level of charge, some features of ball-machine 101 can be disabled to save power. For example, radios 108 may be shut down during ball-machine operation and turned on when data needs to be sent or received. In some embodiments, power management unit 110 instructs ball-machine 101 to park itself to a charging station 115 where its battery 113 can be charged wirelessly or via a cable 114. In some embodiments, when the battery level falls below a certain threshold (e.g., substantially 20%), the player or user is informed by an alarm or any suitable means (e.g., through a message on a smart device) to be aware of the low battery and possible lower performance of ball-machine 101. In some embodiments, the user or player can override the ball-machine's decision to lower its performance when the battery power lowers down.

In some embodiments, ball-machine 101 can work with multiple players on a court. For example, the ball-machine can be used for training multiple players by throwing balls to each player according to their performance or grade level. As such, the same machine can be used for coaching multiple players on a court and each player receives balls according to their skill level programmed into the profiler.

Figure 2:
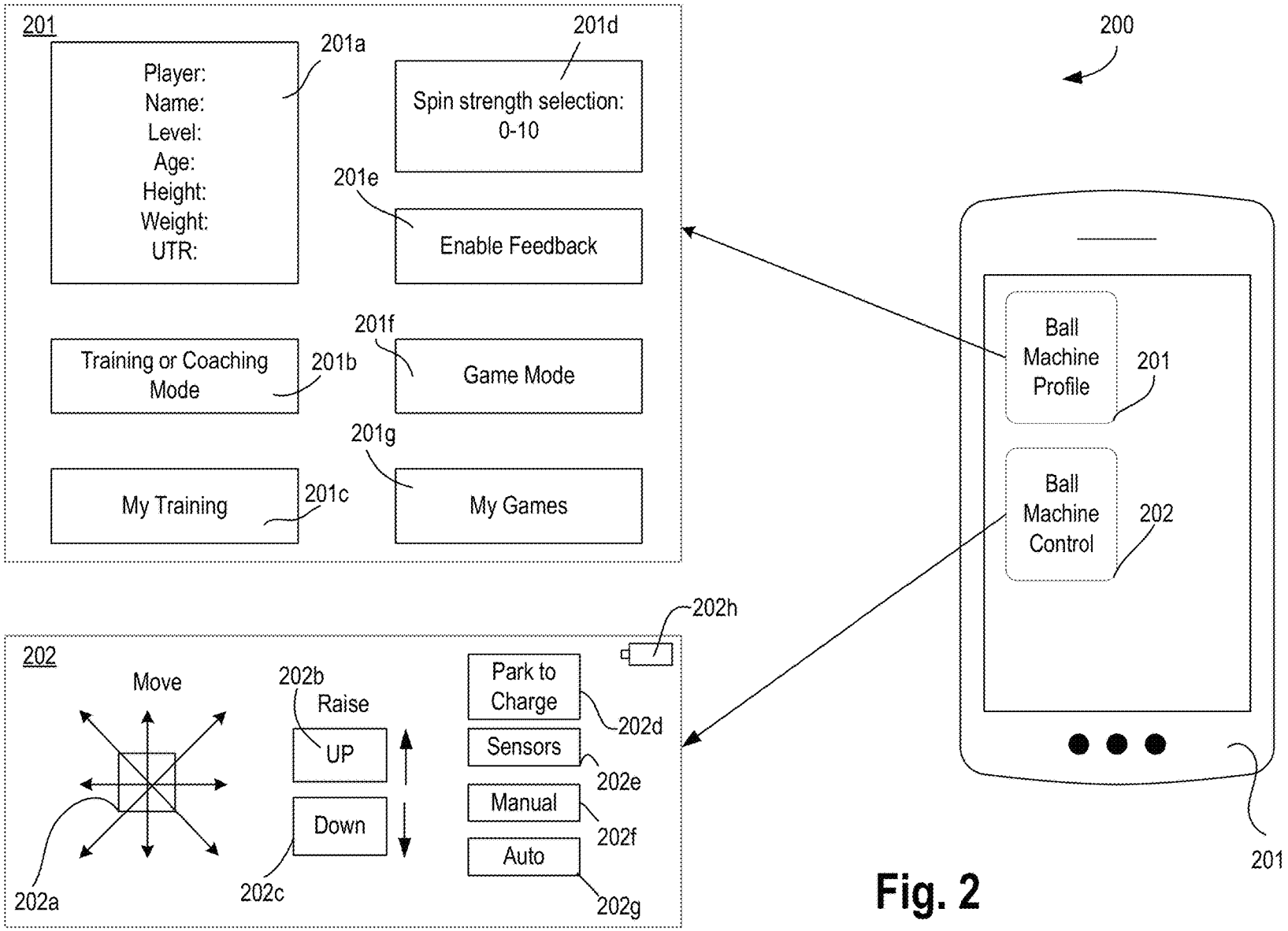
FIG. 2 illustrates a smartphone, tablet, or any suitable handheld control device having one or more applications (apps) to configure and/or control the ball-machine, in accordance with some embodiments.

FIG. 2 illustrates smartphone 200 (tablet, or any suitable handheld control device) having one or more applications (apps) 201 and/or 202 to configure and/or control ball-machine 101, in accordance with some embodiments. In some embodiments, the smart phone (or any computing device having applications) is used to control or configure ball-machine 101. In some embodiments, a user downloads the ball-machine profile application to set a user's profile and to control ball-machine 101.

Profile 201*a* may include player information (e.g., name, game level, age, height, gender, weight, and Universal Tennis Rating (UTR), etc.). In some embodiments, application 201 provides various operations for a user to set ball-machine 101. These operations include training or coaching mode 201*b*, customized training 201*c* for the player whose profile is managed by profile 201*a*, ball spin strength selection 201*d*, player feedback mode 201*e*, game mode 201*f*, and types of games 201*g*.

For example, the user or player can engage with ball-machine 101 to play a complete game (e.g., game mode 2010, or to make machine 101 behave as a coach 201*b* (e.g., training mode). In some embodiments, the player has access to its training and game performance by clicking the "My Training" 201*c* or "My Games" 201*g* tabs. In some embodiments, game mode 201*f* can include two ball machines connected together remotely where two players can now play virtually against each other. In some embodiments, player 201*a* can enable feedback 201*e* where ball-machine 101 provides training messages to improve a game. For example, ball-machine 101 may tell a player (via any means) how to return a ball launched towards the player.

In some embodiments, a player may set various attributes of a ball to be launched. For example, a player may set a spin strength using a lookup table 201*d* for the ball by selecting a number between, for instance, 0 to 10, where 10 is the fastest spin. Spin direction (clockwise or counter clockwise) can also be adjusted by application 201. Spinning a ball can cause the ball to swing in the air, or swing upon a bounce. Spin can be applied on a side of a ball which causes the ball to move, for example, from right to left through the air and continue to move in that direction off of a bounce.

In some embodiments, a player can set the bounce characteristics of a ball using application 201. For example, a player can cause the bounce to be low due to the side pin. In another example, the ball may jump or kick up off the ground as a result of heavy topspin applied to the ball by ball-machine 101. In some embodiments, a player can set the trajectory of the ball after landing in the court. For example, a player can instruct ball-machine 101 to move the ball from right to left through the air and continue to move in that direction off of the bounce. In one case, the ball launched by ball-machine 101 springs off the ground and bounces high. A heavy topspin applied to the ball during the serving motion by the robotic arm of the machine may allow a user to hit high above the net with the ball.

Application 201 can also provide the statistics of the player's performance via enable feedback tab 201*e*. Feedback may include a number of forced versus unforced errors made by the player. Application 201 can also determine and inform the player of the movement towards the ball. For example, how many steps the player took to reach the ball before hitting the ball. The statistics also provide speed of the ball. The statistics also provide placement of the ball relative to the player or relative to the lines of the court. Application or software 201 can publish graphs showing performance of the player overtime relative to a target or an ideal player. These statistics can also be shown on a screen on the ball-machine 101, on smart phone 200, or a screen on the tennis court.

In some embodiments, smart phone 200 has an additional application 202 to control ball-machine 101. Application 202 can be a separate application or integrated within application 201. The controls include joystick mode 202*a* that allows a player to move ball-machine 101 in any direction using a touch pad or touch screen of the smart phone (or device). Further controls include raising or lowering a launching stage of ball-machine 101 using software buttons 202*b* and 202*c*, respectively. The player can lift up or down machine 101 to change the service angle of the ball.

Control 202*d* causes ball-machine 101 to park itself to a charging station to charge its battery. For example, machine 101 can be instructed to move to its charging station. Control 202*e* provides information measured by the various sensors on ball-machine 101. Controls 202*f* and 202*g* allow for manual or auto control of ball-machine 101. In some embodiments, machine 101 operates in manual mode where a user tells machine 101 how and when to throw the ball. For example, a coach can use machine 101 to demonstrate a ball launch during a training session. In some embodiments, a user may enable an auto mode where ball-machine 101 plays with the player or trains a player according to the profile downloaded onto the machine. Application 202 also indicates the battery charge level of ball-machine 101 via battery symbol 202*h*. By clicking or pressing battery symbol 202*h*, the details of the battery charge-level in percentage is illustrated. Further, details of battery performance overtime and life expectancy is also available by clicking battery symbol 202*h*.

Figure 3:
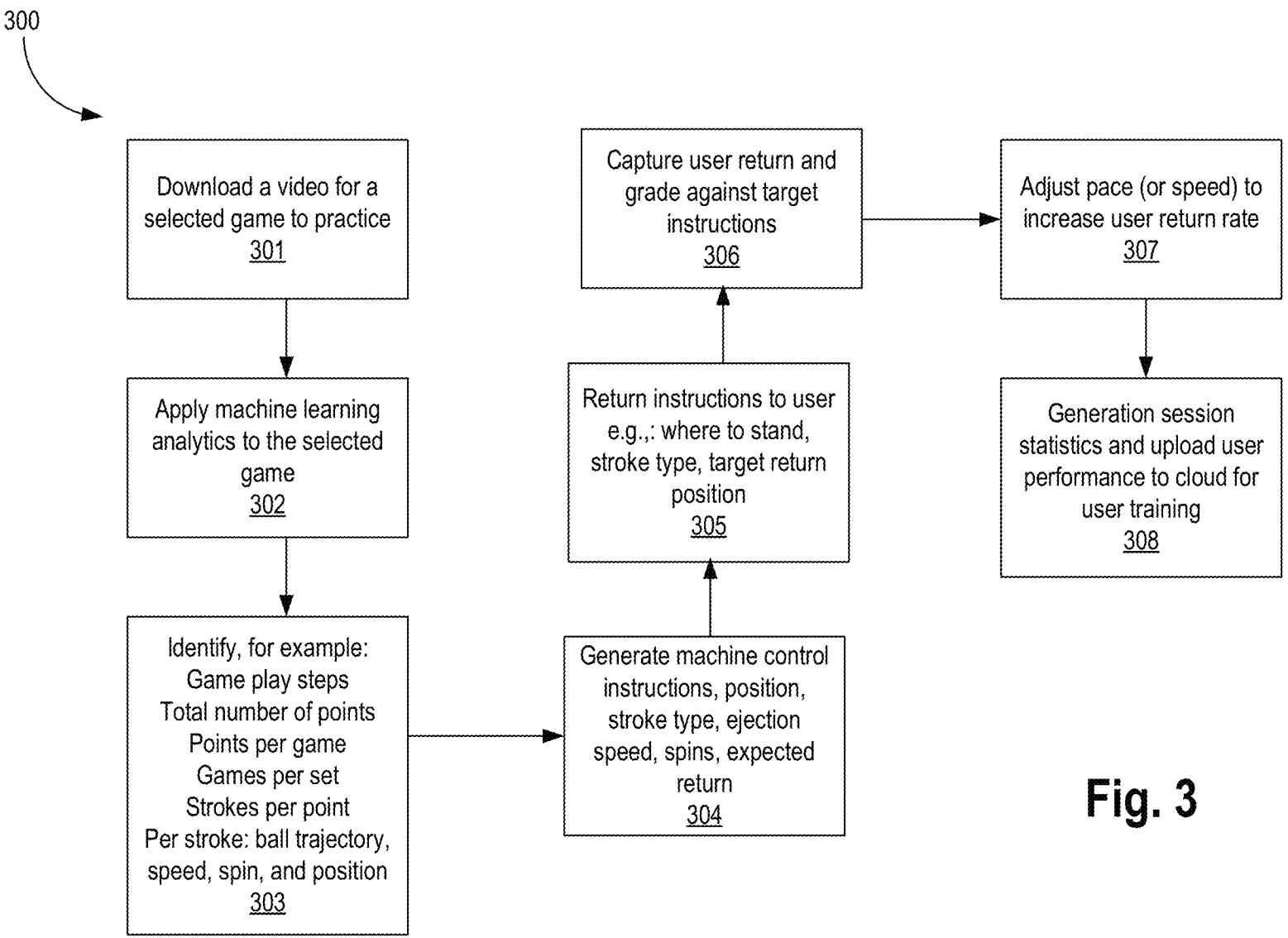
FIG. 3 illustrates a high-level flowchart of the ball-machine operation, in accordance with some embodiments.

FIG. 3 illustrates a high-level flowchart 300 of ball-machine 101 operation, in accordance with some embodiments. While various blocks are illustrated in a particular order, the order may not be determinative. For example, some blocks may be performed before others or in parallel to other blocks. In this operating model, a video of a game (e.g., a tennis game) is downloaded at block 301 onto ball-machine 101 for a selected game to practice by a player. Ball-machine at block 302 applies machine learning or artificial intelligence to the selected game to identify various aspects of the downloaded game.

In some embodiments, input for machine learning are provided by block 303. For example, ball-machine 101 determines the total number of points won or lost by the player in the video, points per game set, strokes per point, ball trajectory for each stroke, speed of the ball return by the player in the video, spin on the ball, position of the ball as it falls on the opposing court.

Using all this information gleaned from the video downloaded on machine 101, at block 304, ball-machine 101 generates instructions for processor 105 to execute. These instructions provide controls for various aspects of ball-machine 101. For example, ejection speed of the ball, spin on the ball, bounce height, etc. The instructions are then applied to the control system of ball-machine 101. These instruction include instructions to move ball-machine 101 to a specific location on the court, controls the robotic arm to position the launching nozzle in at a specific height, control the different spinning wheels in the launching mechanism to launch the ball with a specific stroke along in a target trajectory with the target spin and speed, etc.

At block 305, ball-machine 101 prepares return instructions for each ball thrown to the player on the court. For example, ball-machine 101 may instruct the player on the court where to stand, what type of stroke to play upon receiving the ball, etc.

Consider a tennis ball impacting the z=0 plane, travelling freely with velocity $v_x$,$v_z$vx,vz, and with rotation vector $\omega_x$ωx,$\omega_y$ωy,$\omega_z$ωz. This is the general case, since the z-axis is perpendicular to the wall, and the x-axis is parallel to the velocity in the plane of the wall.

At the time of impact, the friction force of the ball will quickly and irreversibly enforce the no-slip condition, before any significant deformation of the ball. The reason is that the total impulse (momentum transfer) from the impact is about 2M$v_x$2Mvx, so that the available friction impulse is of the order of 2 μM$v_x$2μMvx, where μμ is the coefficient of friction, which is of order 1, and this is much bigger than the impulse required to enforce no slip or a reasonable range of ωω, say 10-500.

Here, no-slip-on-contact means that the friction impulse imparted to the ball in the x-y plane $P_x$,$P_y$Px,Py must satisfy the following:

$$V_x+P_xM=R\omega_y-\alpha P_xMvx+PxM=R\omega y-\alpha PxM$$

$$P_yM=R\omega_x-\alpha P_y\text{MPyM}=R\omega x-\alpha PyM$$

These conditions enforce that the velocity and the angular velocity after the impulse are those required for no-slip. This gives the impulse. The constant αα is the coefficient of the moment of inertia, $$I=MR2\alpha I=MR2\alpha$$

For a shell, like a tennis ball, α=3α=3.

These conditions determine the outgoing velocity in the x,y directions and the outgoing angular velocity in the x,y directions.

$$\Delta Vx=R\omega y-vx1+\alpha\Delta Vx=R\omega y-vx1+\alpha$$

$$\Delta Vy=R\omega x1+\alpha\Delta Vy=R\omega x1+\alpha$$

The z direction is executing a reflection independent of the x and y, because once no-slip is established, the elastic process happens as it would for a non-rotating ball. The final z velocity is κvzκvz in the opposite direction, so that $$\Delta vz=-(1+\kappa)vz\Delta vz=—(1+\kappa)vz$$

Where κκ is a phenomenological bounce-loss parameter, for a tennis ball, I would guess about 0.8 (from bouncing tennis balls, they go back to about 64% of their original height each bounce).

The final values of ωxωx and ωyωy are determined by no-slip $$\omega fy=vxR\omega yf=vxR$$

$$\omega fx=vyR\omega xf=vyR$$

The undetermined quantity is the final value of ωzωz, the rotation in the plane of the impact wall. This rotation is reduced by the friction force as the ball elastically deforms, and bounces off. This can be expressed as:

$$\omega fz=q(vz,\mu)\omega z\omega zf=q(vz,\mu)\omega z$$

where q(vz,μ)q(vz,μ) is a phenomenological function which is parametrized. The friction torque is reduced by the impact area from the friction force, and this is a factor of maybe 1% for a ball at 60 m/s, but the total friction impact available is 2μMvz2μMvz, which is about 100 times the amount needed to stop a reasonable rotation.

In some embodiments, at block 306, ball-machine also grades the player's return against the instruction. This is part of the adaptive feedback system. As such, ball-machine 101 learns the gaming behavior of the player and adjusts one or more parameters of the ball-machine accordingly. For example, when ball-machine 101 determines from the cameras and infrared sensors that the player returned the ball back as expected, ball-machine 101 throws a new ball with higher speed, topspin to further challenge the player. In another example, when ball-machine 101 determines that the player was not successful in a repeated manner to return the ball according to the downloaded game, the machine lowers the difficultly level by throwing easy and slower balls with less topspin so the player can hit the ball back, as indicated by block 307

As such, ball-machine 101 is adaptive in its function of throwing the ball according to the player's game and abilities. In some embodiments, at block 308, ball-machine 101 generates a session statistics about the game with the player so the player can understand his or her weakness and strengths to improve the game. In some embodiments, the statistics are uploaded to the cloud for a user or player to access at a later time. In some embodiments, sensors embedded in the player's racket are also used to provide information wirelessly to ball-machine 101 so ball-machine 101 can adjust the parameters of ball-machine 101 to throw the ball according to the ball return by the player. In some embodiments, one or more drones provide data regarding movement of player and the ball to ball-machine 101 so ball-machine 101 can gather all-round data regarding the player and the ball. In some embodiments, sensors on the court also provide data to ball-machine regarding movement of player and the ball. These various sensors allow ball-machine 101 to build a complete report for the player.

Figure 4:
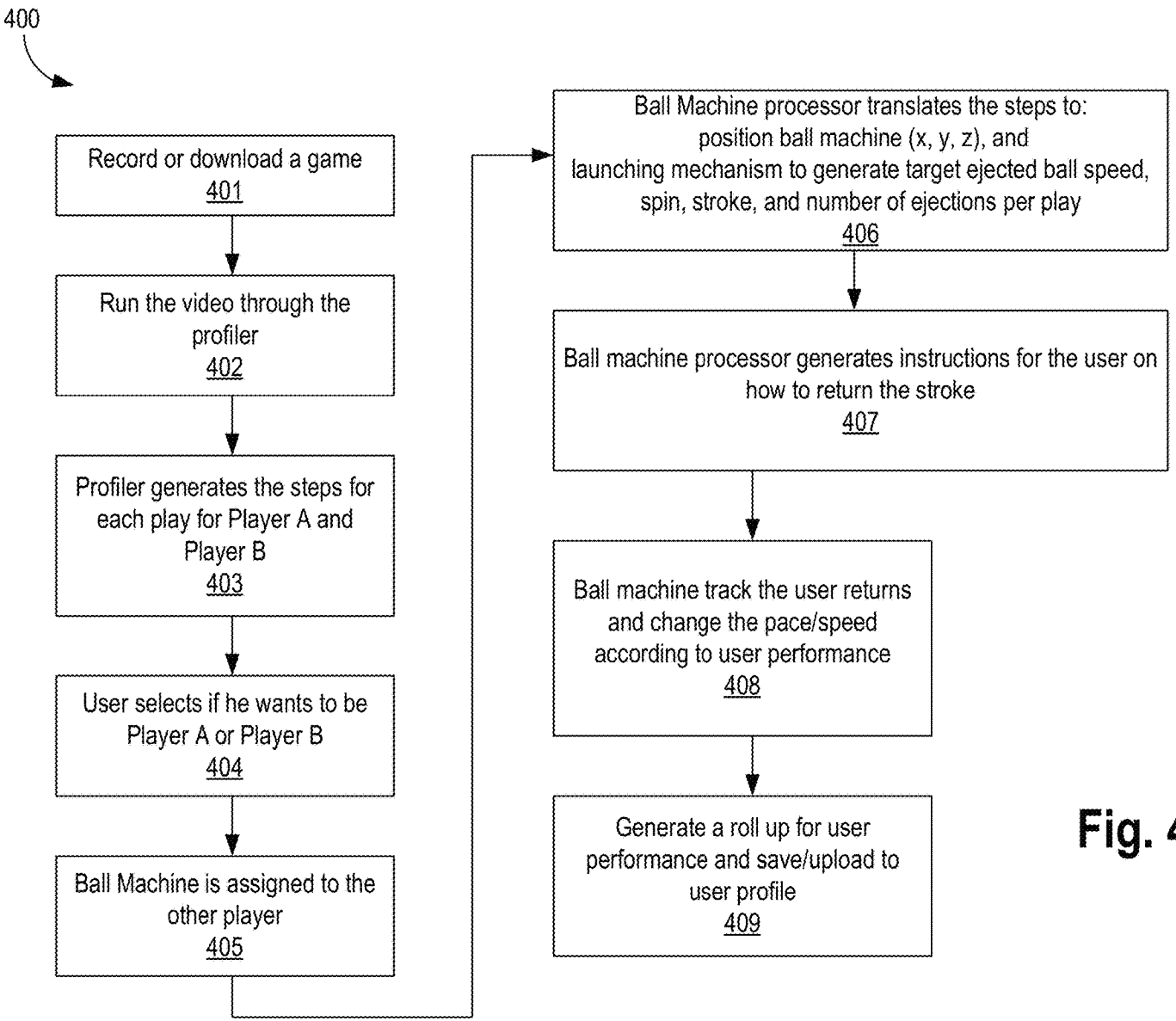
FIG. 4 illustrates a flowchart for setting a profile for the ball-machine, in accordance with some embodiments.

FIG. 4 illustrates flowchart 400 for setting a profile for the ball-machine, in accordance with some embodiments. While various blocks are illustrated in a particular order, the order may not be determinative. For example, some blocks may be performed before others or in parallel to other blocks.

At block 401, a game of interest is downloaded or recorded onto a computer or ball-machine 101. This game would be a game that a player would like to play with the ball-machine 101, for example. The game can be downloaded in any suitable format. At block 402, the downloaded game is provided to profiler 103. Profiler 103 may be a parser or a software that analysis the game. At block 403, profiler 103 generates a file detailing steps of each play for the players. For example, in a singles tennis game, profiler 103 jots down the time, shot type, location of ball bouncing, speed of ball, spin of the ball, etc. played by player A and player B.

At block 404, a user then selects the type of player he or she wants to be like. This is the player that ball-machine 101 would play against. User can use application 201 to select the type of player.

At block 405, ball-machine 405 is assigned the other player. For example, if a user selects player A then ball-machine 101 becomes player B. Ball-machine 101 then plays with the user to practice so that user can become as proficient in the game as the selected player by the user.

At block 406, processor 105 of ball-machine 101 translates the steps generated by profiler 103 to position ball-machine 101 for playing the game or for practicing with the user. Cartesian coordinates x, y, and x identify the position of ball-machine 101. Any suitable units can be used for these coordinates. For example, ball-machine can move in feet, inches, centimeters, millimeters, etc. Processor 105 translates these steps into target ejected ball speed, spin, stroke type, number of ball ejections per play, etc.

At block 407, ball-machine 101 generates instructions for the user about how to return the stroke. For example, ball-machine 101 may provide a message on a display screen visible to the user about changing grip position of the racket, angle of hitting the ball, and/or timing (i.e. when) to hit the ball.

At block 408, processor 105 of ball-machine 101 tracks the ball return shots by the user and changes the speed or pace of the launched ball (from ball-machine 101) according to the user performance. For example, if the user was unsuccessful with the return shot, then ball-machine 101 launches a ball with lower speed to the user so that user can improve the return shot. Block 408 may be an interactive process as user plays an entire game or training session period.

At block 409, processor 105 generates a performance report for the user. The report are saved in memory for later viewing of downloaded. The report are uploaded to cloud for further statistical analysis, in accordance with some embodiments. The report are transmitted to the user's smart device 200. The report are displayed on any display in the court, in accordance with some embodiments. The report may include graphs, tables, and recommendations, for example.

Figure 5:
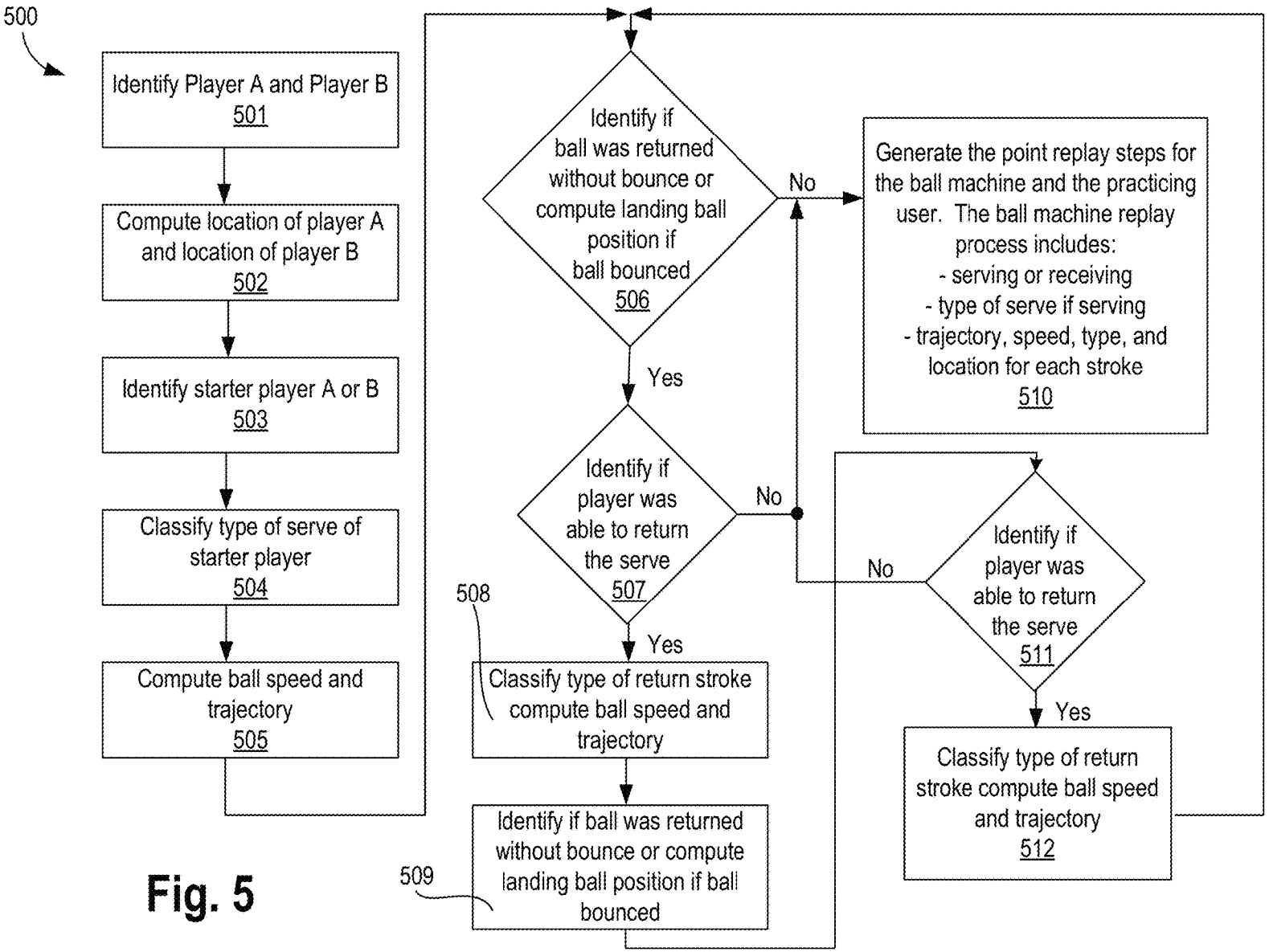
FIG. 5 illustrates a flowchart for adaptive training of a player using the ball-machine, in accordance with some embodiments.

FIG. 5 illustrates flowchart 500 for adaptive training of a player using the ball-machine, in accordance with some embodiments. While various blocks are illustrated in a particular order, the order may not be determinative. For example, some blocks may be performed before others or in parallel to other blocks.

At block 501, processor 105 identifies player A and player B from the data generated by profiler 103. At block 502, processor 105 computes the current location of player A on the court and player B on the court. As discussed herein, profiler 103 generates a complete layout of the tennis court, and processor 105 uses that data to determine where player A and player B are located for a given play. At block 503, processor 105 identifies the starting player. The starting player is the one that will serve the ball. If the user is to serve first, then ball-machine 101 monitors the performance of the serve. For example, ball-machine 101 determines whether the serve hit its expected mark on the court, speed of the ball, spin on the ball, bounce of the ball, etc. for future statistical and performance analysis.

At block 504, processor 105 classifies the type of serve the first player would play. The serve may be a first serve or second serve (which is generally slower than the first serve). At block 505, processor 105 determines the speed, spin, bounce, trajectory and expected landing point of the serve ball. If ball-machine 101 is to serve first, processor 105 provides the necessary control settings to the various components discussed with reference to FIG. 1 so that ball-machine 101 makes the expected serve. Once the serve is made (either by ball-machine 101 or the user), ball-machine 101 computes the performance of the serve. For example, ball-machine 101 determines the speed, spin, bounce, trajectory and actual landing point of the serve ball.

At block 506, processor 105 determines whether the user returned the serve ball without bounce. Processor 105 also determines the landing point of the ball if the ball bounced in the court. If processor 105 determines that the return serve was a faulty return (e.g., without bounce or the bounce fell outside the legal court boundary), then the process proceeds to block 510. Otherwise, the processor proceeds to block 507.

At block 510, processor 105 generates the point replay steps for the launching system 106. For example, ball-machine 101 replays the shot by serving the serve again, or asking the user to re-do the serve. Ball-machine 101 may also provide instructions to the user to make a successful serve. For example, ball-machine 101 provides estimated angle (trajectory) for hitting the ball and force level to hit the ball. If ball-machine 101 is to replay the serve, processor 105 provides the necessary control parameters to ball launching system 106 and motor drive control system 107 to play the same serve again.

At block 507, processor 105 determines whether the user (or player) returns the serve correctly. If it did not, the process proceeds to block 510 where the serve is replayed. Otherwise, the process proceeds to block 508. At block 508, processor 105 classifies the type of return stroke by the user and computes the ball parameters. Examples of ball parameters include speed, spin, bounce, trajectory and actual landing point of the serve ball.

At block 509, processor 105 identifies whether the user returned the ball without bounce, and as such determines the actual landing point (x, y, z coordinates) of the ball. Processor 105 proceeds to block 511 where it determines whether the return was ever made. If the ball never returned, then ball-machine 101 sets up a replay as indicated by block 510. If the player returns the ball, then the process proceeds to block 512. At block 512, ball-machine 101 determines the return performance parameters of the ball. These parameters include speed, spin, bounce, trajectory and actual landing point of the serve ball. The process then proceeds to block 506. The operations of the blocks may be combined with other blocks when flowchart 500 is coded into a programming language.

Elements of embodiments (e.g., flowchart and scheme described with reference to various figures) are provided as a machine-readable medium (e.g., memory) for storing the computer-executable instructions (e.g., instructions to implement any other processes discussed herein). In some embodiments, computing platform comprises processor 105, memory 109, machine-readable storage media (also referred to as tangible machine readable medium and part of memory 109), communication interface (e.g., wireless or wired interface such as radios 108), and network bus (e.g., bus connecting various components of ball-machine 101 of FIG. 1). In some embodiments, machine-readable storage medium 109 includes instructions (also referred to as the program software code/instructions) for analyzing the profile, generating instructions for ball-machine 101 according to the profile or downloaded game, providing feedback or instructions to the player on the court, etc. with reference to various embodiments and flowchart.

Program software code/instructions associated with the flowcharts (and/or various embodiments) and executed to implement embodiments of the disclosed subject matter may be implemented as part of an operating system or a specific application, component, program, object, module, routine, or other sequence of instructions or organization of sequences of instructions referred to as "program software code/instructions," "operating system program software code/instructions," "application program software code/instructions," or simply "software" or firmware embedded in processor. In some embodiments, the program software code/instructions associated with the flowcharts (and/or various embodiments) are executed by ball-machine 101.

In some embodiments, the program software code/instructions associated with the flowcharts (and/or various embodiments) are stored in a computer executable storage medium 109 and executed by processor 105 of ball-machine 101. Here, computer executable storage medium is a tangible machine readable medium that can be used to store program software code/instructions and data that, when executed by a computing device, causes one or more processors to perform a method(s) as may be recited in one or more accompanying claims directed to the disclosed subject matter.

The tangible machine-readable medium 109 may include storage of the executable software program code/instructions and data in various tangible locations, including for example ROM, volatile RAM, non-volatile memory and/or cache and/or other tangible memory as referenced in the present application. Portions of this program software code/instructions and/or data may be stored in any one of these storage and memory devices. Further, the program software code/instructions can be obtained from other storage, including, e.g., through centralized servers or peer-to-peer networks and the like, including the Internet. Different portions of the software program code/instructions and data are obtained at different times and in different communication sessions or in the same communication session.

The software program code/instructions (associated with the flowcharts and other embodiments) and data are obtained in their entirety prior to the execution of a respective software program or application by the computing device. Alternatively, portions of the software program code/instructions and data can be obtained dynamically, e.g., just in time, when needed for execution. Alternatively, some combination of these ways of obtaining the software program code/instructions and data may occur, e.g., for different applications, components, programs, objects, modules, routines or other sequences of instructions or organization of sequences of instructions, by way of example. Thus, it is not required that the data and instructions be on tangible machine-readable medium 109 in entirety at a particular instance of time.

Examples of tangible computer-readable media 109 include but are not limited to recordable and non-recordable type media such as volatile and non-volatile memory devices, read only memory (ROM), random access memory (RAM), flash memory devices, floppy and other removable disks, magnetic storage media, optical storage media (e.g., Compact Disk Read-Only Memory (CD ROMS), Digital Versatile Disks (DVDs), etc.), among others. The software program code/instructions may be temporarily stored in digital tangible communication links while implementing electrical, optical, acoustical or other forms of propagating signals, such as carrier waves, infrared signals, digital signals, etc. through such tangible communication links.

In general, tangible machine readable medium 109 includes any tangible mechanism that provides (i.e., stores and/or transmits in digital form, e.g., data packets) information in a form accessible by a machine (i.e., a computing device), which may be included, e.g., in a communication device, a computing device, a network device, a personal digital assistant, a manufacturing tool, a mobile communication device, whether or not able to download and run applications and subsidized applications from the communication network, such as the Internet, e.g., an iPhone®, Galaxy®, Blackberry® Droid®, or the like, or any other device including a computing device. In one embodiment, processor-based system is in a form of or included within a PDA (personal digital assistant), a cellular phone, a notebook computer, a tablet, a game console, a set top box, an embedded system, a TV (television), a personal desktop computer, etc. Alternatively, the traditional communication applications and subsidized application(s) are used in some embodiments of the disclosed subject matter.

Figure 6A:
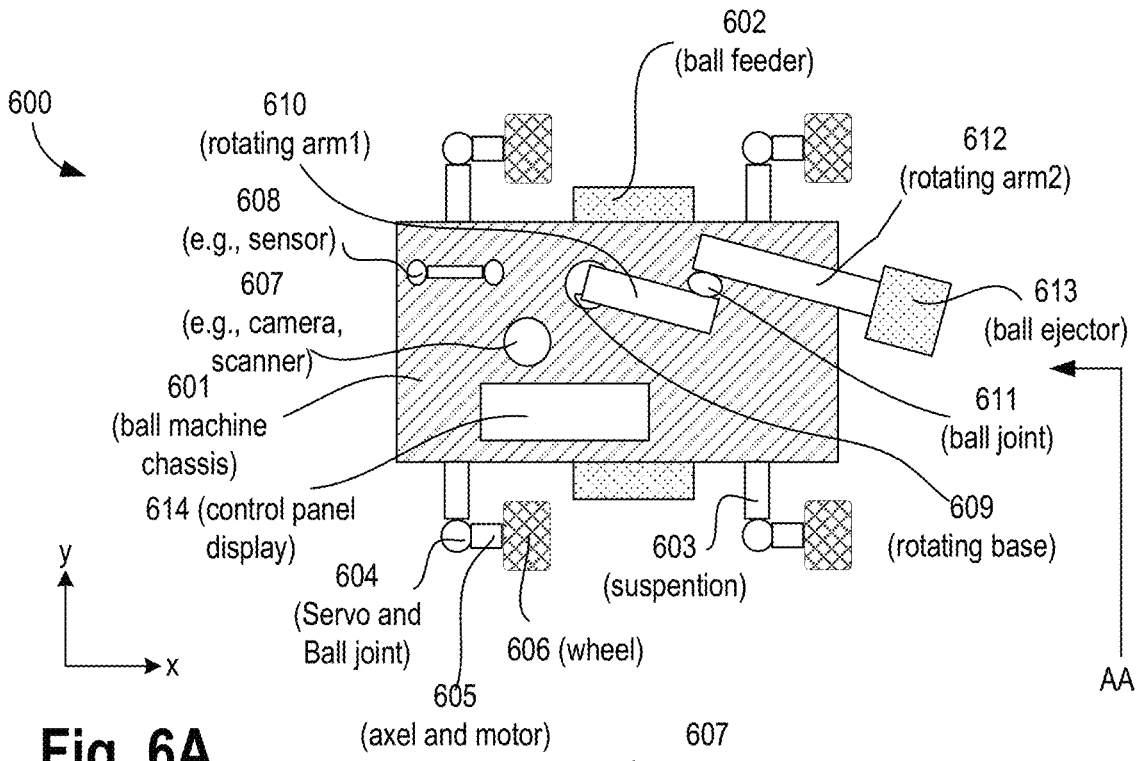
FIGS. 6A-B illustrate a top view and a corresponding side view, respectively, of a ball-machine with robotic arm, respectively, in accordance with some embodiments.
Figure 6B:
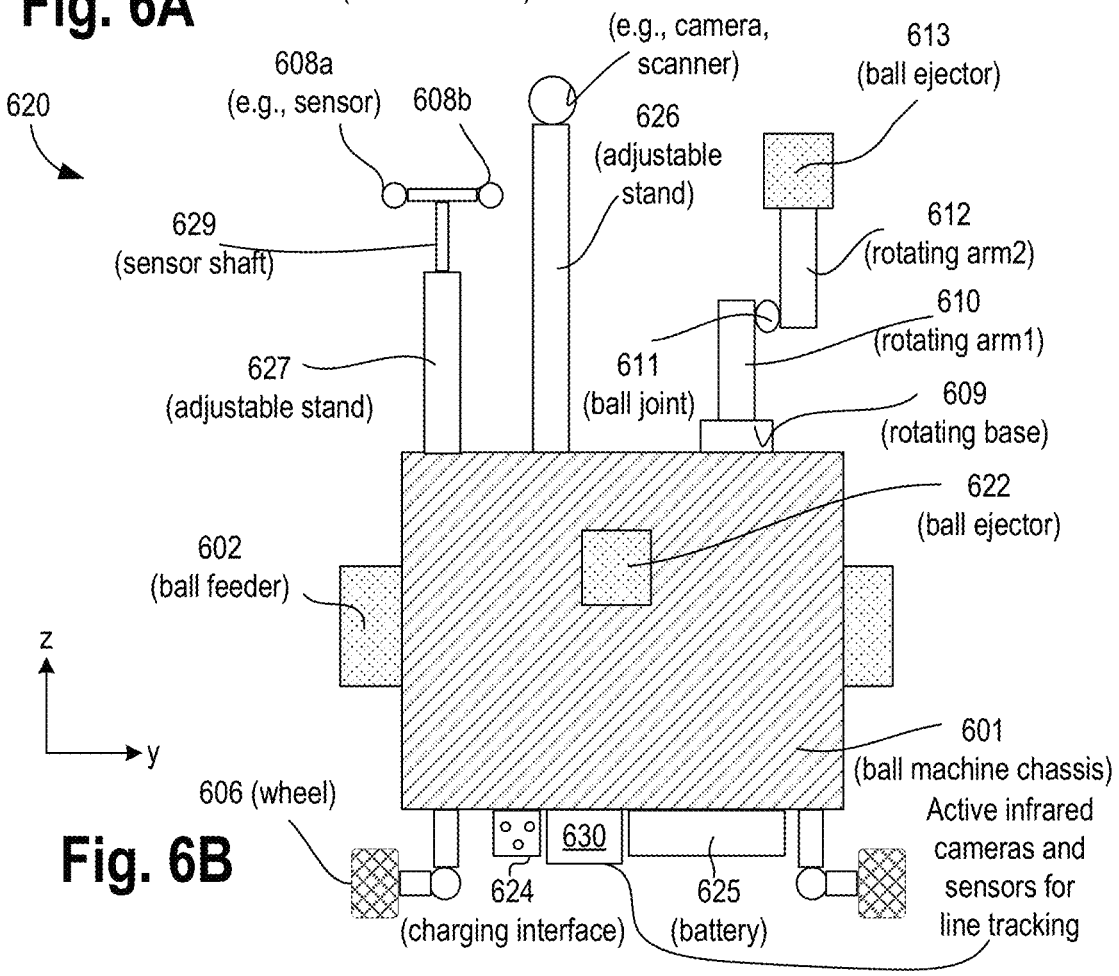

FIGS. 6A-B illustrate top view 600 and corresponding side view 620, respectively, of ball-machine 101 with robotic arm, respectively, in accordance with some embodiments. Side view 620 is along the point AA. In some embodiments, ball-machine 101 comprises chassis 601, ball feeder 602, wheel suspension 603, ball joints 604, axel 605, wheels 606, camera/scanner 607, sensor(s) 608, rotating base 609, rotating arm1 610, ball joint 611, rotating arm2 612, ball ejector 613, and control panel display 614.

In some embodiments chassis 601 comprises a lightweight sturdy material such as aluminum, reinforced plastic, etc. In some embodiments, ball-feeder 602 is attachable to a bag or a container that feeds many balls (e.g., 30-40 balls) to ball-machine 101. Chassis 601 rests on suspension 603 coupled to wheels 606 via ball joint 604 and axel 605. Ball joint 604 provides the 360-degree rotation to wheels 606, which allows ball-machine 101 to move in any direction along a base plane. In some embodiments, all wheels 606 are independently controllable. In some embodiments, processor 105 controls all wheels 606 together such that all wheels 606 rotate exactly by the same angle. While four wheels 606 are illustrated, fewer (e.g., three) or more (e.g., five or more) wheels can be attached to chassis 601. For example, ball container (not shown) may have its own wheel or may be suspended when attached to ball feeder 602. Each wheel may have an associated motor and servo to allow the wheels to be independently controlled. For example, rotation speed and angle of the wheel are controlled by the motor and servo.

In some embodiments, camera and/or scanner 607 (e.g., camera 111) is positioned on top of chassis 601 to get a 360-degree view of the premises. Camera and/or scanner 607 are securely attached to ball-machine 101 via adjustable stand 626. The height of adjustable stand 626 can be adjusted manually or by an electric motor. Cameras and/or scanner 607 sense the launched ball as it launches from ball-machine 101. Cameras 607 also monitor the balls returned by a player. In some embodiments, cameras 607 include 360° camera or stereo camera and/or one or more infrared cameras. In some embodiments, cameras 607 capture video of the user responding to the different strokes generated by ball-machine 101. The infrared cameras 607 can be used to track the ball and player using their thermal trail. For example, when the player changes position or the ball touches the court, the memory aspect of the infrared camera can capture the player's position for a couple (or more) frames until the player's thermal footprint reaches equilibrium with the surrounding. The same is applicable to the ball trail. For example, when a ball hits the court, energy is transferred from the ball to the court in the impact area and even through the ball has already moved on; the position of the ball can be captured on the court for couple of frames using the infrared camera. Cameras 607 can be visible light cameras or infrared cameras, or a mix of both types.

One or more sensors 608*a/b* (e.g., 112) are also attached to chassis 601 via shaft 629. Sensors 608*a/b* include a mini weather station to measure the atmospheric pressure, wind speed and temperature and to provide the ambient measurements for processor 105 to apply correction factors to launching system instructions for the play steps to compensate for the ambient effects on the ball trajectory. In some embodiments, sensors 608*a/b* are directly attached to an adjustable stand 627. In some embodiments, sensors 608*a/b* are attached to adjustable stand 627 via sensor shaft 629. Height of stand 627 can adjust manually or by an electric motor.

Ball-machine 101 may have one or multiple ball ejectors. Top view 600 shows ball ejector 613 attached to robotic arms 610 and 612 that can move in any direction along the x-y-z plane. Robotic arms 610 and 612 couple via ball joint 611 that allows for z-direction movement of robotic arm 612. The base of robotic arm 610 couple to a rotating base 609. The rotating base provides the movement along the x-y plane. In various embodiments, a motor is tied to the rotating base 609 that rotates base 609 and then locks it in position before a ball is ejected by ball ejector 613. The robotic arms 610 and 612 can be used to simulate a serve of the ball. In some embodiments, robotic arms 610 and 612 includes a pressure system to blow the ball out. The pressure of the air determines how fast the ball is ejected. Various nozzles force air to the ball to push the ball out at a high velocity. In some embodiments, small-motorized wheels are embedded in the ball ejector attached to the robotic arm just like the wheels for ejecting the ball for the other ball ejector. Side view 620 shows ball ejector 622 on the side of chassis 601. Unlike ball ejector 613, ball ejector 622 is located on the side of chassis 601. The operation mechanism of ball ejector 613 is also applicable to ball ejector 622, but for ball ejector 622 being in a fixed location.

In various embodiments, ball-machine 101 includes a display panel 614 on the top of chassis 601. Display 614 may include a touch pad or any suitable display. Display 614 is waterproof or water resistant allowing ball-machine 101 to operate in various weather conditions.

Ball/sports machine 101 also includes a charging interface 624 and a battery bank 625 (Li-ion). Power management system 110 monitors the battery level or charge level of battery 625 (113) using a fuel gauge of battery 625. Charging interface 624 may be a fast charging interface such as a DC charger. In some embodiments, a regular AC plug can attach to charging interface 624 to charge battery 625. In some embodiments, charging interface 624 is the same charging interface used for charging electric cars.

Depending on the level of charge, processor 105 disables some features of ball-machine 101 to save power. For example, processor 105 may shut down radios 108 during ball-machine operation and turn on when data needs is sent or received. In some embodiments, when the battery level falls below a certain threshold (e.g., 20%), the player or user is informed by an alarm or any suitable means (e.g., through a message on a smart device) to be aware of the low battery and possible lower performance of ball-machine 101. In some embodiments, the user or player can override the ball-machine's decision to lower its performance when the battery power lowers down.

The tires of wheels 606 (that can be rubber tires) have a pressure monitoring system, which communicates with processor 105 and informs processor 105 of the current pressure of the tires. If any of the tire pressure lowers below a recommended threshold, processor 105 will inform the player or/and display on its screen 614 a warning to attend to the tire with low pressure.

Ball-machine 101 also includes active infrared cameras and sensors 630 for sensing the white lines on the court. These sensors help the ball-machine identify its location relative to the lines and also calibrate the launching system of the ball so the ball lands on an expected location.

Figure 7A:
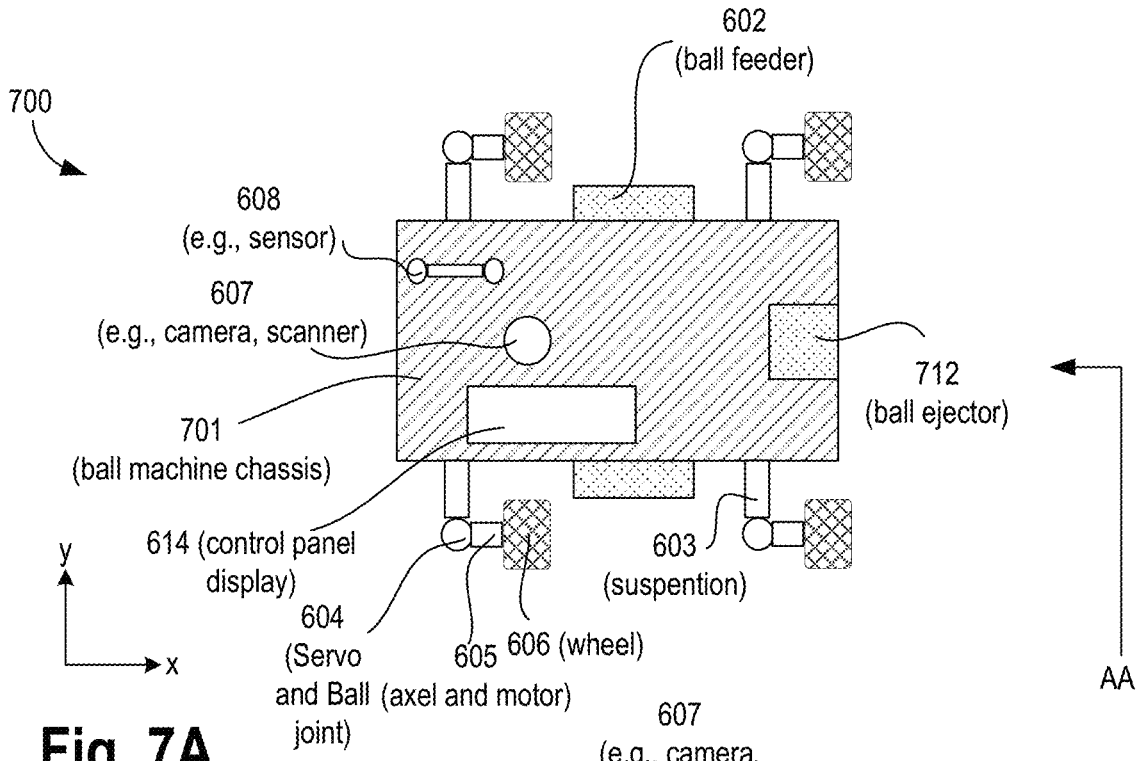
FIGS. 7A-B illustrate a top view and a corresponding side view, respectively, of a ball-machine with a lift, respectively, in accordance with some embodiments.
Figure 7B:
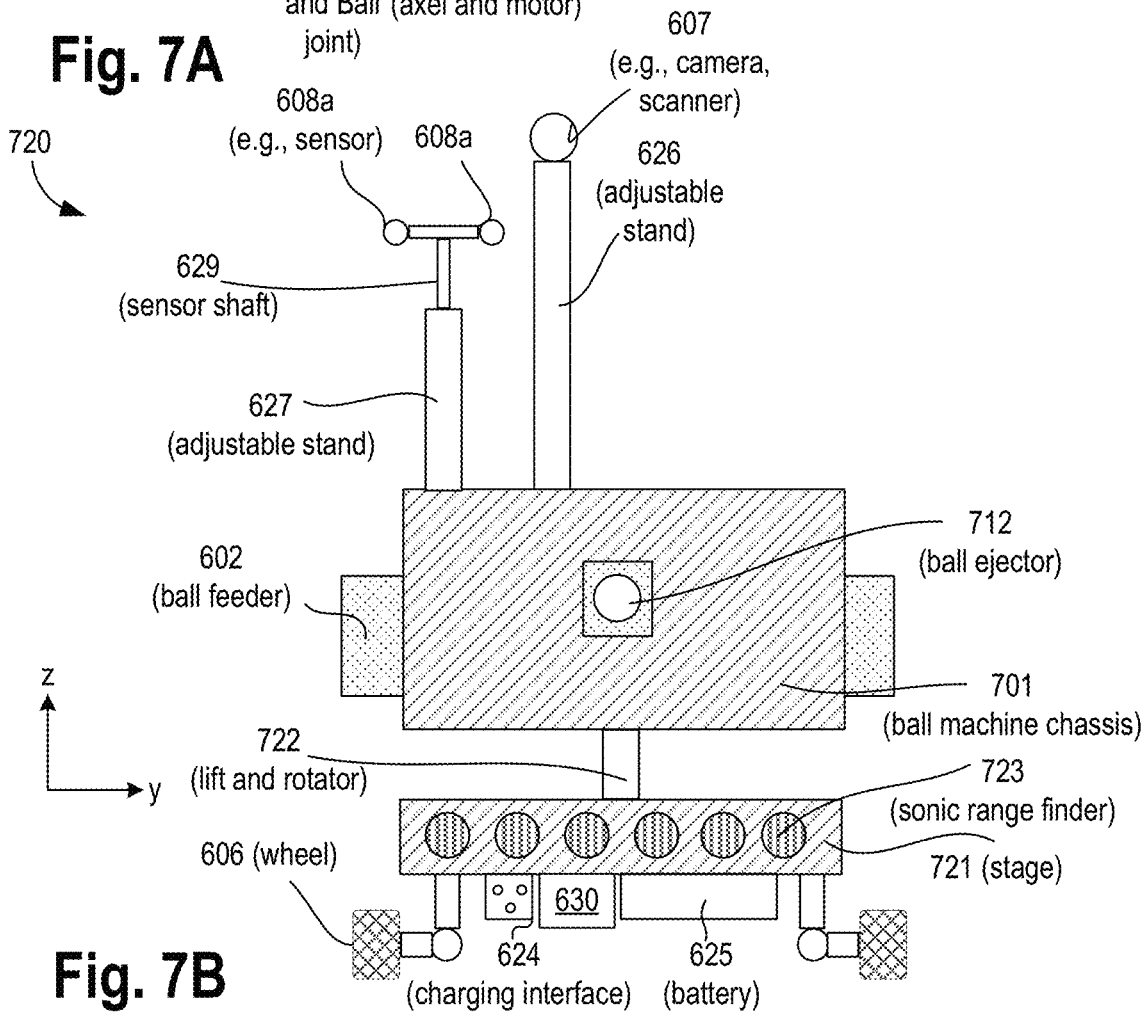

FIGS. 7A-B illustrate top view 700 and corresponding side view 720, respectively, of a ball-machine with a lift, respectively, in accordance with some embodiments. Side view 720 is along interface AA. Here, chassis 701 has a fixed ball ejector 712, which couples to ball feeder 602. Chassis 701 couples to stage 721 via a lift and rotator shaft 722. Lift and rotator shaft 722 allows for raising or lowering chassis 701 along the x-axis, while wheels 606 move the chassis 701 along the x-y plane. In some embodiments, lift and rotator 722 are hydraulic. In some embodiments, an electric motor and pulley control the mechanical components of lift and rotator 722. Depending on the desired ball trajectory, processor 105 can raise or lower lift and rotator 722.

In various embodiments, stage 721 has a plurality of range finders 723 (e.g., sonic range finders). Range finders 723 determine the map of the court including its lines so that ball ejector rejects balls within the court boundaries. Sonic ranger finder 723 also determines the bounce of the ball on the court. The lift mechanism 722 can raise or lower chassis 701 to change the angle of trajectory the ball. In some embodiments, the robotic arm with its ball ejector is in addition to lift mechanism 722.

Figure 8:
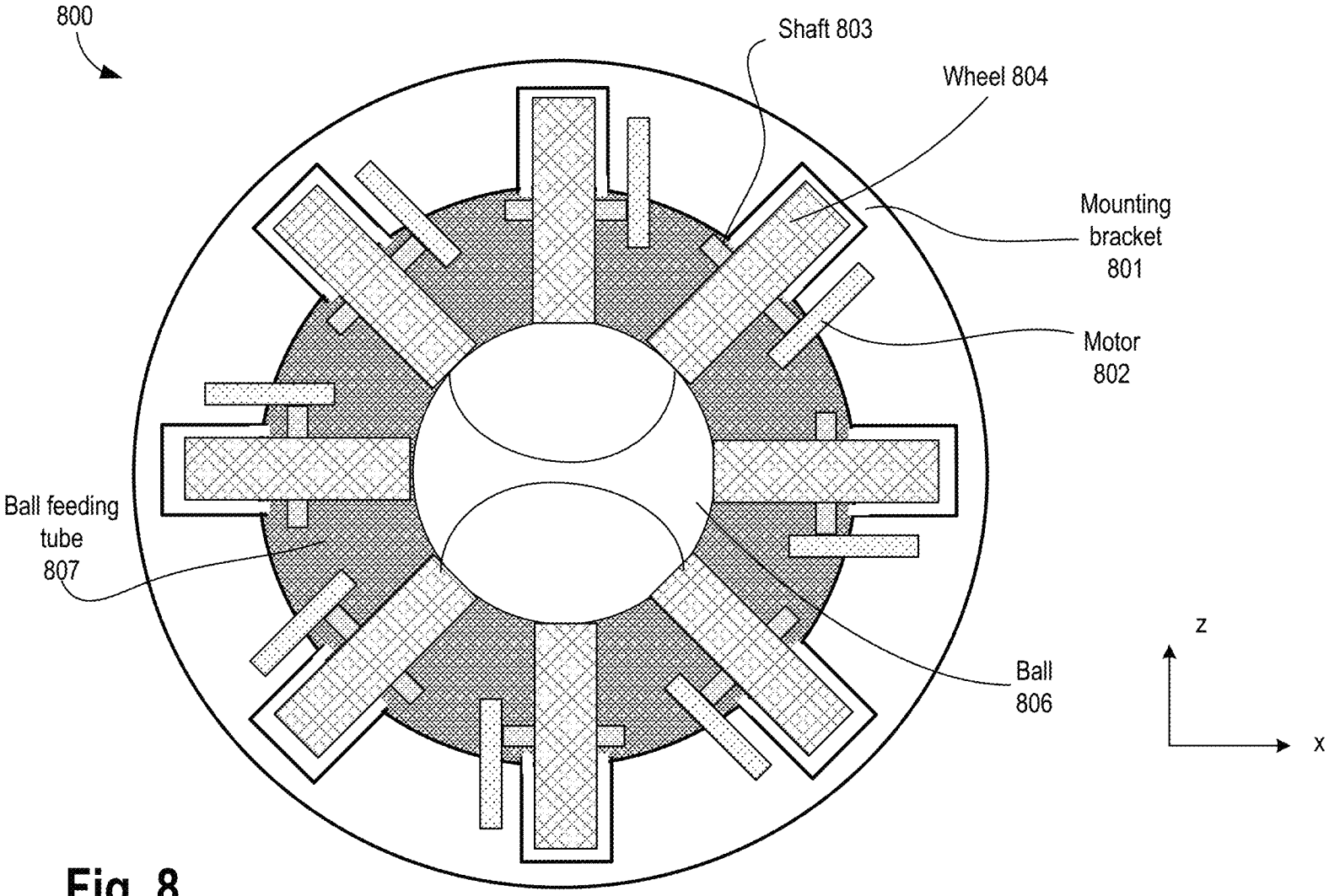
FIG. 8 illustrates a cross-section of a ball launching mechanism with a plurality of wheels, motors, and shafts, in accordance with some embodiments.

FIG. 8 illustrates cross-section 800 of a ball launching mechanism with a plurality of wheels, motors, and shafts, in accordance with some embodiments. Ball launching mechanism (106 and 107) include a mounting bracket 801, a plurality of motors 802, a polarity of shafts 803, a plurality of wheels 804, and call feeding tube 807. Ball 806 from feeding tube 807 is in the center and surrounded by multiple wheels 804. Each wheel 804 is controlled by a corresponding motor 802 attached to a corresponding shaft 803. The multiple wheels 804 also project ball 806 at any angle, and also allow a variety of possible spins to the ball 806. Processor 105 independently controls each wheel 804. For example, processor 105 adjusts the angular velocity of each wheel 804. Further, processor 105 can adjust the friction of each wheel 804 to the ball 806 by pressing the wheel harder or easier on ball 106. The motors are electric motors, in accordance with some embodiments. In various embodiments, processor 105 independently controls some wheels or each wheel 804 to generate a desired spin to ball 806 at launch time. In some embodiments, air pressure along with wheels 804 control the forward motion of ball 806 at launch time.

Figure 9:
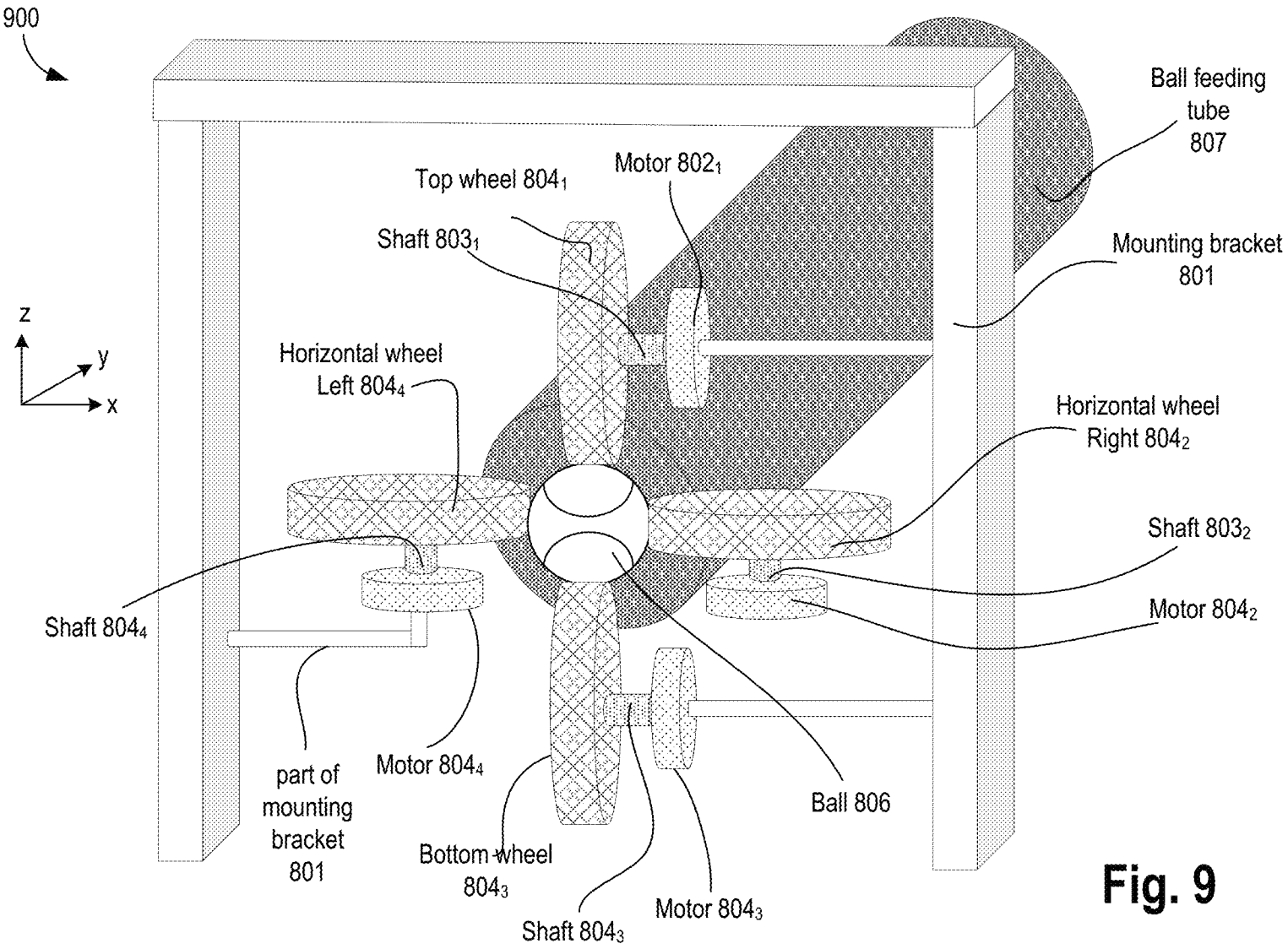
FIG. 9 illustrates a three dimensional (3D) view of the ball-machine, in accordance with some embodiments.

FIG. 9 illustrates a three dimensional (3D) view 900 of the ball-machine, in accordance with some embodiments. The 3D view 900 shows how the multiple wheels connect to mounting bracket 801 via their corresponding shafts. Here, a set of four wheels, shafts, and motors are shown. The first set is the top set comprising top wheel $\mathbf{804}_1$, motor $\mathbf{802}_1$ and shaft $\mathbf{803}_1$. Shaft $\mathbf{803}_1$ couples to mounting bracket 801. The second set is the first horizontal set comprising wheel $\mathbf{804}_2$, motor $\mathbf{802}_2$ and shaft $\mathbf{803}_2$. Shaft $\mathbf{803}_2$ couples to mounting bracket 801. The third set is the bottom set comprising wheel $\mathbf{804}_3$, motor $\mathbf{802}_3$ and shaft $\mathbf{803}_3$. Shaft $\mathbf{803}_3$ couples to mounting bracket 801. The fourth set is the second horizontal set comprising wheel $\mathbf{804}_4$, motor $\mathbf{802}_4$ and shaft $\mathbf{803}_4$. Shaft $\mathbf{803}_4$ couples to mounting bracket 801. While four sets are shown, any number of sets are can be used for controlling the speed and spin of ball 806. Feeding tube or belt 807 can hold a number of balls (e.g., 20-30 balls). Processor 105 can also change the frequency of firing out balls.

Figure 10:
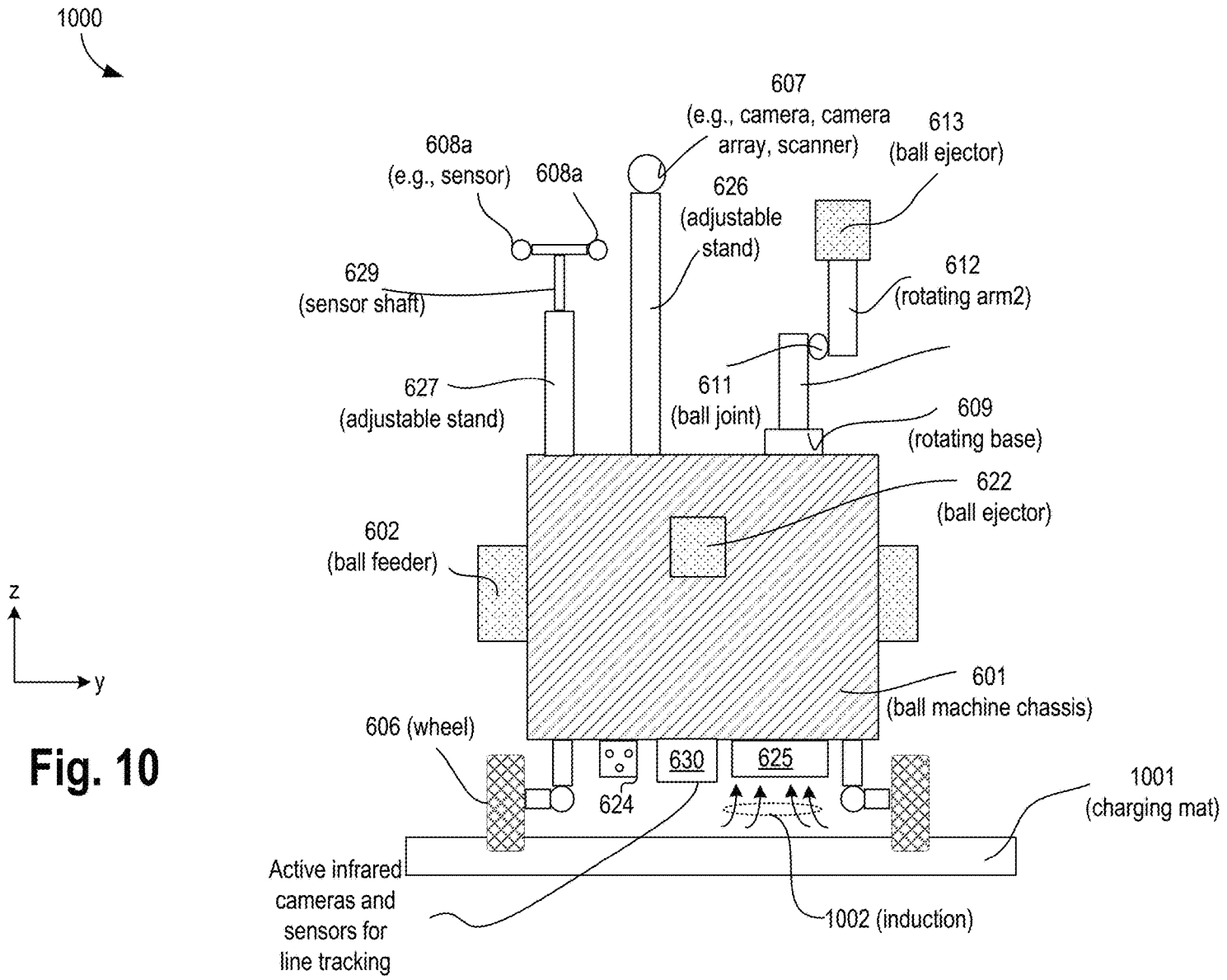
FIG. 10 illustrates a side view of the ball-machine of FIG. 6B configured to charge wirelessly via a charging mat, in accordance with some embodiments.

FIG. 10 illustrates a side view 1000 of the ball-machine of FIG. 6B configured to charge wirelessly via a charging mat, in accordance with some embodiments. In some embodiments, power management unit 110 instructs ball-machine 101 to park itself to a charging station 115 (e.g., charging mat 1001), where its battery 113 can be charged wirelessly or via a cable 114. Upon reaching a low battery level (e.g., 5% batter left), ball-machine 101 moves itself to charging mat 1001 to inductively charge battery 625. Charging mat 1001 produces electromagnetic fields 1002. For example, charging mat 1001 uses an induction coil to create an alternating electromagnetic field. A receiver coil in battery bank 625 converts the alternating electromagnetic field back into electricity to be fed into the battery 625. Any suitable technique can be used for charging battery 625 via charging mat 1001.

Figure 11:
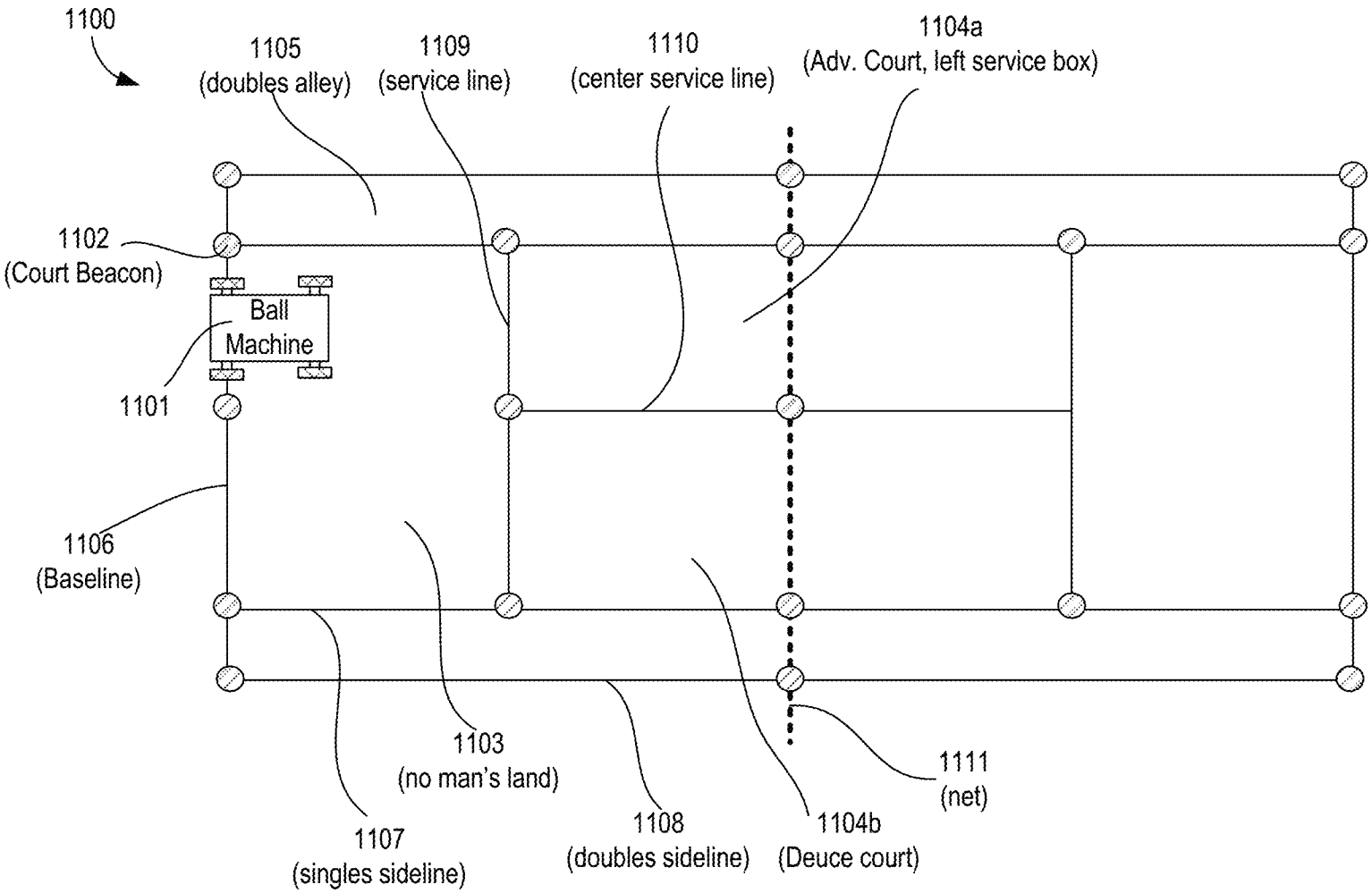
FIGS. 11-13 illustrate top views of a tennis court with sensors communicatively coupled to the ball-machine, in accordance with some embodiments.
Figure 12:
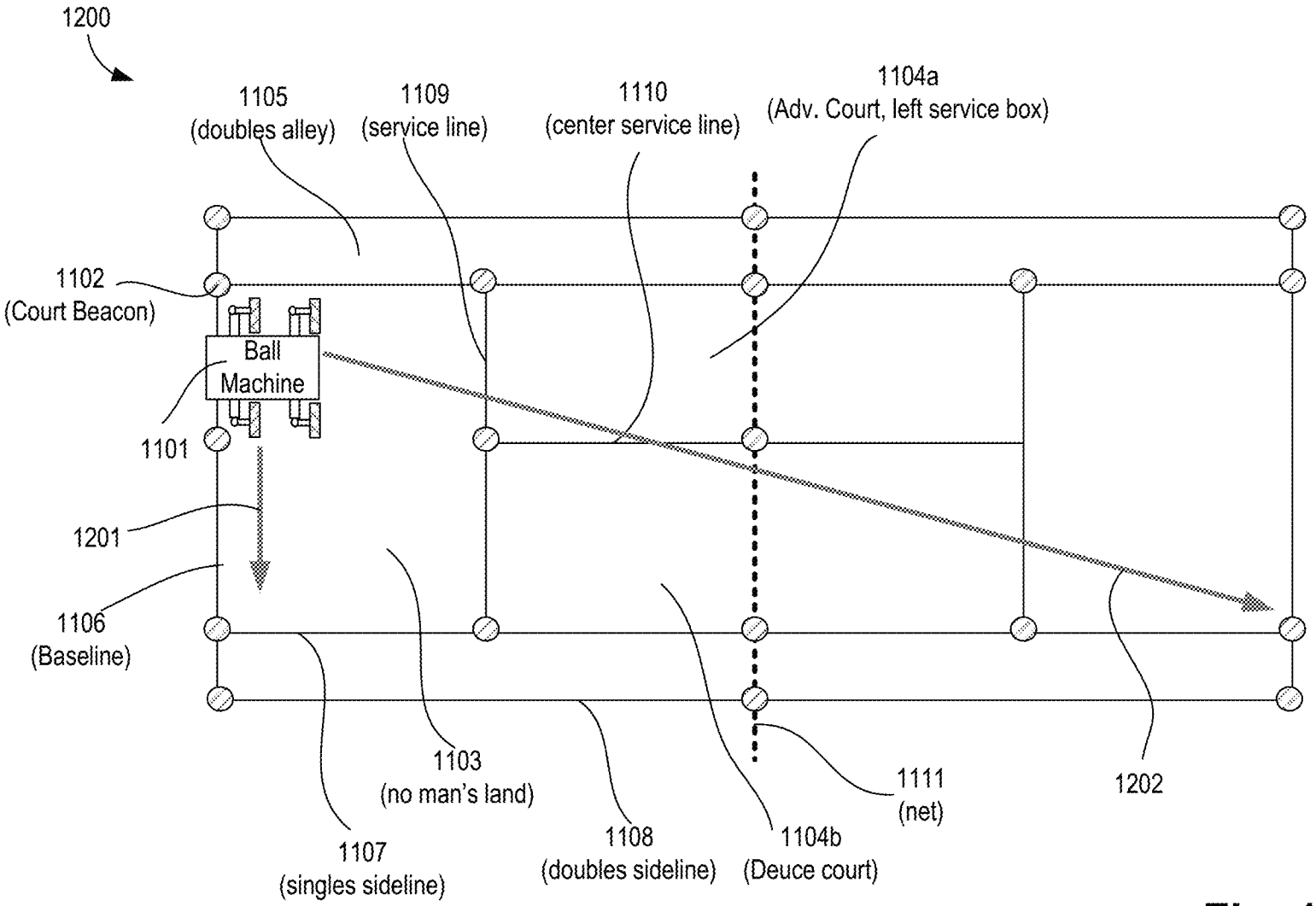
Figure 13:
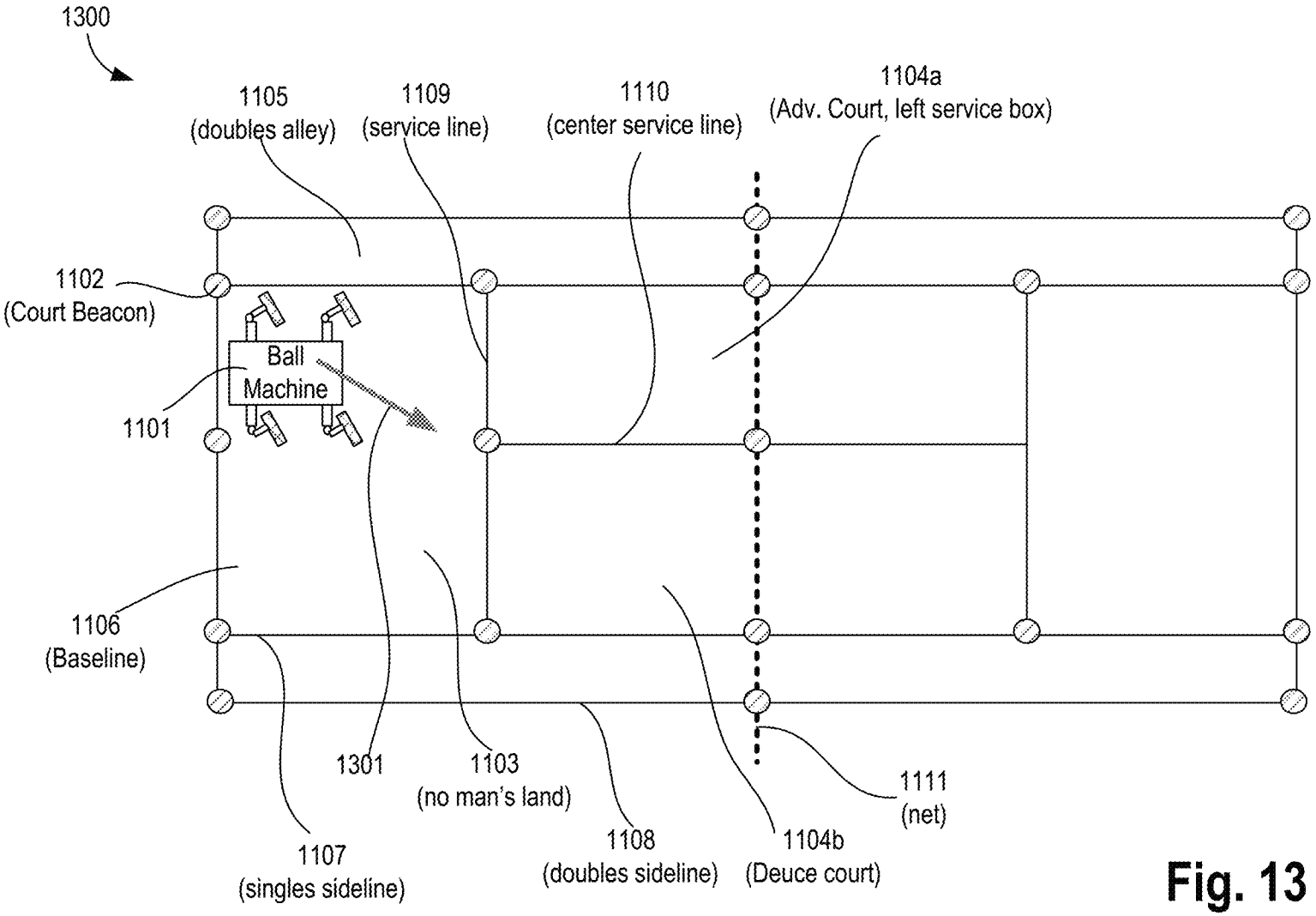

FIGS. 11-13 illustrate top views 1100, 1200, and 1300 of a tennis court with sensors communicatively coupled to ball-machine, 1101 (or 101) in accordance with some embodiments. In some embodiments, ball-machine 1101 works with sensors 1102 on the court. These sensors are embedded at various intersections of the court lines or stripes. The court includes sections such as no man's land 1103, advantage (Adv.) court 1104*a*, deuce court 1104*b*, and doubles alley 1105. Here, stripes are marked so ball-machine, 1101 (or 101) can make a map of the court to analyze placement of the ball during practice or a game. These stripes include baseline 1106, singles sideline 1107, doubles sideline 1108, service line 1109, center service line 1110, and net 1111. The ball-machine is on one side of the court while the player or user are on the other side.

FIG. 12 shows moving the ball-machine parallel to baseline 1106 of the court. In some embodiments, processor 105 aligns all four wheels parallel to baseline 1106 of the court so that ball-machine 1101 can move parallel to baseline 1106 along path 1201. This allows ball-machine 1101 to throw a ball diagonal to the court along line 1202. While the various embodiments illustrate four wheels for the machine, the machine can also have three wheels like a tricycle. In some embodiments, the single wheel of the 3-wheel is controllable to rotate in any direction along the x-y plane. In some embodiments, all three wheels of the 3-wheel machine are independently controllable.

FIG. 13 shows the wheels being set at an angle allowing ball-machine 1101 to move in court at an angle along path 1301. The 4-way steering of the wheels allows for such angle of all balls. In some embodiments, to pack the machine in a carry-on or suite case configuration, all wheels are folded in.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications and variations of such embodiments will be apparent to those of ordinary skill in the art in light of the foregoing description. The embodiments of the disclosure are intended to embrace all such alternatives, modifications, and variations as to fall within the broad scope of the appended claims.

Various embodiments are provided as examples. These examples can be combined in any suitable manner. These examples include:

Example 1: A ball-machine comprising: at least three wheels to control trajectory and speed of a ball; a memory; and a processor coupled to the memory, wherein the processor to: control the at least three wheels according to a profile setting, receive instructions including a profile of a player, apply machine-learning analytics to the received instructions; and control the at least three wheels according to the profile of a player and the applied machine-learning analytics.

Example 2: The ball-machine of example 1 comprising a robotic arm to eject the ball, wherein the processor is to control a position of the robotic arm according to the profile of the player or performance of a second player in real time.

Example 3: The ball-machine of example 1 comprising a lift to raise a ball ejector, wherein the processor is to control a height of the lift according to the profile of the player or performance of a second player in real time.

Example 4: The ball-machine of example 1 comprising a single or a plurality of 360° cameras to monitor the ball ejected from the ball-machine, wherein the processor is to compile data for a performance report of a player according to the monitored ball.

Example 5: The ball-machine of example 1 comprising a single or a plurality of infrared cameras to monitor the ball ejected from the ball-machine, wherein the processor is to compile data for a performance report of a player according to a heat signature of the ball captured by the infrared camera.

Example 6: The ball-machine of example 1, wherein the at least three wheels have four-way steering to move the ball-machine in any direction along an x-y plane.

Example 7: The ball-machine of claim 1 comprising one of more sensors including weather-monitoring sensors, where the processor is to use an output of the weather monitoring sensors to control a ball launching system.

Example 8: The ball-machine of example 1 comprising a connectivity interface to connect the processor with one or more external devices.

Example 9: The ball-machine of example 7, wherein the connectivity interface includes a WiFi interface.

Example 10: The ball-machine of example 1 comprising a rechargeable battery.

Example 11: The ball-machine of example 1, wherein the processor is to change one or more controls of the ball-machine according to a performance of a player receiving the ball.

Example 12: The ball-machine of example 1, wherein the ball-machine is accessible by a smartphone, tablet or a remote computer.

Example 13: The ball-machine of example 1, wherein the processor is to process feedback from a racket and from other sensors on a drone or on the court.

Example 14: A machine-readable storage media having machine-executable instructions, that when executed, cause one or more processors to perform a method comprising: downloading a video of a selected game to practice; applying machine-learning analytics to the selected game to identify gaming parameters; generating machine control instructions, according to the identified gaming parameters, to set a ball-machine to play against a user; returning instructions to the user according to the identified gaming parameters; capturing a return of a ball by the user and grading the return against target instructions; adjusting pace of the ball to improve the return rate of the ball; generating game statistics for the user according to a gaming performance of the user including the return rate; and uploading the game statistics to a cloud.

Example 15: The machine-readable storage media of example 14, wherein the gaming parameters include: total number of points, points per game, games per set, strokes per point, ball trajectory, ball speed, ball spin, and ball landing points.

Example 16: The machine-readable storage media of example 14, wherein machine control instructions include: x-y-z coordinates of the ball-machine, stroke type, ball ejection speed, ball spin, and location of expected return.

Example 17: The machine-readable storage media of example 14, wherein the returning instructions include: location of the user to stand at, stroke type, and target return position.

Example 18: A machine-readable storage media having machine-executable instructions, that when executed, cause one or more processors to perform a method comprising: downloading a video of a selected game to practice; generating gaming parameters, for a first player and a second player, form the downloaded video; providing an option to a user to select gaming parameters for one of the first or second players, wherein the unselected gaming parameters are associated with a ball-machine; translating the gaming parameters, associated with a ball-machine, to x-y-z position of the ball-machine, target of the ejected ball, spin of the ball, and number of ball ejections per play; providing instructions for the user on how to return a ball; tracking return of the ball by the user; adjusting parameters of the ball-machine according to the tracked return; generating a performance report for the user; and uploading the performance report to a cloud.

Example 19: The machine-readable storage media of example 18, wherein the gaming parameters include: total number of points, points per game, games per set, strokes per point, ball trajectory, ball speed, ball spin, and ball landing points, and wherein tracking return of the ball by the user includes: landing point of the ball and speed of the ball.

Example 20: The machine-readable storage media of example 18 having machine-executable instructions, that when executed, cause the one or more processors to perform a method comprising: recharging a battery of the ball-machine once a battery level falls below a threshold.

Example 21: A ball-machine comprising: a processor; and a single or plurality of ball launching mechanisms, where each launching mechanism comprises of two or more spinning wheels, where direction of rotation and speed of each of the spinning wheels is individually controllable by the processor to synthesize or control trajectory, spin and speed of a ball to be launched.

Example 22: The ball-machine of example 21 comprising: a robotic arm to eject the ball, wherein the processor is to control a position of the robotic arm according to a profile of a first player or performance of a second player in real time; and a lift to raise a ball ejector, wherein the processor is to control a height of the lift according to the profile of the first player or performance of the second player in real time.

Example 23: The ball-machine of example 21 comprising: a 360° camera to monitor the ball ejected from the ball-machine, wherein the processor is to compile data for a performance report of a player according to the monitored ball; and an infrared camera to monitor the ball ejected from the ball-machine, wherein the processor is to compile data for a performance report of a player according to a heat signature of the ball captured by the infrared camera.

An abstract is provided that will allow the reader to ascertain the nature and gist of the technical disclosure. The abstract is submitted with the understanding that it will not be used to limit the scope or meaning of the claims. The following claims are hereby incorporated into the detailed description, with each claim standing on its own as a separate embodiment.

What is claimed is:

1. An apparatus comprising:

a set of wheels to control trajectory and speed of an object;

a processor communicatively coupled to the set of wheels; and a drone to gather data associated with the object, wherein the drone is communicatively coupled to the processor, wherein the processor is to control the set of wheels according to a set of parameters and the data associated with the object.

2. The apparatus of claim 1, wherein the drone includes one or more sensors to gather the data.

3. The apparatus of claim 1, wherein the data associated with the object includes data of a player on a field.

4. The apparatus of claim 1, wherein the set of parameters includes a profile of a player.

5. The apparatus of claim 4, wherein the processor is to apply machine-learning and the profile of the player to control the set of wheels.

6. The apparatus of claim 5 comprising:

a lift; and an ejector, wherein the processor is to adjust a location of the ejector relative to a base of the apparatus according to an adjustment of the lift, wherein the set of wheels are coupled to the ejector.

7. The apparatus of claim 6, wherein the player is a first player, wherein the processor is to adjust the location of the ejector according to the profile of the first player or performance of a second player.

8. The apparatus of claim 1, wherein the set of wheels have four-way steering.

9. The apparatus of claim 1 comprising a rechargeable battery to provide power to the processor.

10. The apparatus of claim 1, wherein the processor is controllable by a smartphone, tablet, or a remote computer.

11. A method comprising:

gathering data, associated with an object, from a drone; and controlling a set of wheels to adjust a trajectory and speed of the object according to the data and a set of parameters.

12. The method of claim 11 comprising communicatively coupling a processor to the set of wheels.

13. The method of claim 11, wherein gathering the data includes receiving sensing data from one or more sensors of the drone.

14. The method of claim 11, wherein the data associated with the object includes data of a player on a field.

15. The method of claim 11, wherein the set of parameters includes a profile of a player, wherein the method comprises applying machine-learning and the profile of the player to control the set of wheels.

16. The method of claim 15 comprising adjusting a location of an ejector relative to a reference to change a point of ejection of the object from the set of wheels.

17. The method of claim 16, wherein the player is a first player, wherein adjusting the location of the ejector is based on the profile of the first player or performance of a second player.

18. An apparatus comprising:

one or more circuitries to control trajectory and speed of an object based at least in part on data associated with the object and a set of wheels, wherein the data associated with the object is gathered from one or more sensors of a drone.

19. The apparatus of claim 18 comprising:

a lift; and an ejector, wherein the one or more circuitries are to adjust a location of the ejector relative to a base of the apparatus according to an adjustment of the lift, wherein the set of wheels are coupled to the ejector.

20. The apparatus of claim 19, wherein the one or more circuitries is to adjust the location of the ejector according to a first profile of a first player or performance of a second player.

* * * * *